US006964255B2

(12) United States Patent
Shomura et al.

(10) Patent No.: US 6,964,255 B2
(45) Date of Patent: Nov. 15, 2005

(54) OUTBOARD MOTOR

(75) Inventors: Nobuyuki Shomura, Hamamatsu (JP); Tomohiko Miyaki, Iwata (JP); Jiro Saiga, Hamamatsu (JP); Hidehiko Yoshioka, Hamamatsu (JP); Shuichi Hagino, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/742,673

(22) Filed: Dec. 18, 2003

(65) Prior Publication Data

US 2004/0149241 A1 Aug. 5, 2004

(30) Foreign Application Priority Data

Feb. 5, 2003 (JP) ..... 2003-028872

(51) Int. Cl.[7] ..... F02B 77/00
(52) U.S. Cl. ..... 123/198 E; 440/77
(58) Field of Search ..... 123/198 E; 440/77, 440/88

(56) References Cited

U.S. PATENT DOCUMENTS 5,445,547 A * 8/1995 Furukawa ..... 440/77
5,722,360 A * 3/1998 Tsunoda et al. ..... 123/195 P
6,336,434 B1 1/2002 Shomura et al.
6,450,864 B1 9/2002 Smith
6,582,260 B2 6/2003 Nemoto et al.

FOREIGN PATENT DOCUMENTS

JP 10-339167 A1 12/1998
JP 11-198893 A1 7/1999
JP 2000-328952 A1 11/2000
JP 2001-158397 A1 6/2001
JP 2002-137792 A1 5/2002

OTHER PUBLICATIONS

Patent Abstracts of Japan for JP10-339167 published on Dec. 22, 1998.
Patent Abstracts of Japan for JP11-198893 published on Jul. 27, 1999.
Patent Abstracts of Japan for JP2000-328952 published on Nov. 28, 2000.
Patent Abstracts of Japan for JP2001-158397 published on Jun. 12, 2001.
Patent Abstracts of Japan for JP2002-137792 published on May 14, 2002.

* cited by examiner

*Primary Examiner*—Noah P. Kamen
(74) *Attorney, Agent, or Firm*—Darby & Darby

(57) ABSTRACT

An outboard motor includes a vertical multi-cylinder engine, a fly-wheel magneto device, a partition plate, and a ventilation fan. The vertical multi-cylinder engine is disposed in an engine cover and comprises a crank case and a crank shaft, the crank shaft being rotatably disposed and protruding upward from the crank case. The fly-wheel magneto device is disposed on the protruding portion of the crank shaft. The partition plate is disposed in the engine cover and partitions the inside of the engine cover into an engine air-inlet space and a space including a heat-generating source, the engine air-inlet space being disposed at the upper portion of the engine cover, and the space including a heat-generating source being disposed at the lower portion of the engine cover. The ventilation fan is disposed in the lower space below the partition plate.

21 Claims, 17 Drawing Sheets

OUTBOARD MOTOR

CROSS-REFERENCE TO RELATED APPLICATION

The present application claims priority under 35 U.S.C. §119 to Japanese Patent Application No. 2003-028872 filed on Feb. 5, 2003. The content of the application is incorporated herein by reference in its entirety.

BACKGROUND OF THE INVENTION

1. Field of the Invention

The present invention relates to an outboard motor comprising a multi-cylinder engine installed in an engine cover, and, more particularly, to an outboard motor having an efficient supply-and-exhaust structure and fly-wheel magneto structure in an engine compartment.

2. Description of the Related Art

There are prior-art outboard motors, mounted to a transom of the hull of a ship, comprising a V-type multi-cylinder engine or an in-line multi-cylinder engine.

Examples of related prior-art outboard motors are disclosed in Japanese Unexamined Patent Application Publication No. 2002-137792 (JP '792) and Japanese Unexamined Patent Application Publication No. 11-198893 (JP '893).

As shown in FIG. 20, in the outboard motor disclosed in JP '792, a V-type multi-cylinder engine b is disposed in an engine cover a, and the upper portion of an engine compartment c in the engine cover a is partitioned by a partition plate d into a front and a rear portion. In addition, an engine inlet space (path) e is disposed behind the partition plate d. The lower portion of the engine inlet space e opens into the engine compartment c, and, thus, the engine inlet space e is not formed independently of the engine compartment c which includes heat-generating sources such as electrical components and the V-type multi-cylinder engine b.

Also, a forcible-supply-and-exhaust structure is not used in the engine compartment c in the engine cover a. Therefore, heat dissipated from the heat-generating sources, such as the V-type multi-cylinder engine b, in the engine compartment c tends to accumulate. Therefore, a large temperature rise occurs in the engine compartment c. The large temperature rise may overheat the parts in the engine compartment c.

Since the engine inlet space (path) e of engine inlet f opens into the engine compartment c, outside air that flows into the engine cover a is directly affected by heat dissipation caused by combustion in the multi-cylinder engine b and hot lubricant oil circulating in the multi-cylinder engine b. Therefore, the temperature rises. Since air whose temperature has risen in the engine compartment c is used as combustion air, air density is reduced. Consequently, engine output is reduced.

Even in the outboard motor disclosed in JP '893, outside air that flows into an engine cover from the back portion of the top portion of the engine cover flows into an engine compartment through an engine inlet space (path), and is supplied to an engine air-inlet system.

In this case also, since the engine inlet space communicates with the engine compartment from the front inner side of the engine cover, and opens into the engine compartment, air whose temperature has risen in the engine compartment is guided to the engine air-inlet system of a multi-cylinder engine. Therefore, the outboard motor has the same problems as the outboard motor disclosed in JP '792.

Other examples ofl related prior-art outboard motors are disclosed in Japanese Unexamined Patent Application Publication No. 2000-328952 (JP '952), Japanese Unexamined Patent Application Publication No. 10-339167 (JP '167), and Japanese Unexamined Patent Application Publication No. 2001-158397 (JP '397).

In above referenced prior art outboard motors, a vertical multi-cylinder engine is accommodated in an engine cover, and a vertically extending crank shaft (vertical crank shaft) is disposed in the multi-cylinder engine. Since even an outboard motor comprising a vertical multi-cylinder engine needs to be mounted to the transom of the hull of a ship, it is required to be compact and light, and to have its center of gravity disposed at a low position.

As shown in FIG. 21, in such related prior-art outboard motors, a vertical crank shaft h of a multi-cylinder engine g penetrates through the top portion of a crank case i and protrudes upward therefrom by a large amount, and a fly-wheel magneto device j is disposed at this upwardly protruding portion (an upwardly protruding portion n). The fly-wheel magneto device j comprises a fly-wheel k having a large inertia, and a magneto device 1 for generating electrical power.

In order for the fly-wheel k to be stably and integrally rotatably mounted to the vertical crank shaft h, a cylindrical boss m is formed at the central portion of the fly-wheel k, and the upwardly protruding portion n of the crank shaft h is tapered. In addition, a tapered boss hole o of the boss m of the fly-wheel k is externally fitted to the upwardly protruding portion n of the crank shaft h. The hole o and the upwardly protruding portion n are locked by a locking key p, and fastened together by a fastening bolt q.

Although the fly-wheel k, which is fitted to the tapered upwardly protruding portion n of the vertical crank shaft h, is stably and rotationally supported thereby, the contact area is large because the boss m of the fly wheel k that is fitted to the tapered portion of the vertical crank shaft h is thick. Therefore, the axial length of the tapered fitting portion needs to be large.

Consequently, the amount of upward protrusion of the vertical crank shaft h from the crank case i is large, and, thus, the fly-wheel k needs to be tall. For this reason, the position of the center of gravity of the fly-wheel k is high, thereby making it difficult for each of the disclosed outboard motors to have its center of gravity disposed at a low position and to be lightened.

The fly-wheel k needs to have the boss m that does not contribute to the inertia (moment of inertia) of the fly-wheel k. In addition, in order to smoothly rotate the fly-wheel k when the fly-wheel k has the thick boss m, the fly-wheel k needs to have an axial length that is equal to or greater than a certain length. Therefore, the fly-wheel becomes heavier. As a result, it is difficult to make the fly-wheel k light and compact, and the position of the center of gravity of the fly-wheel k is high, thereby hindering stable rotation of the fly-wheel k.

Since the fly-wheel k, which is covered by a fly-wheel magneto cover r, is tall overall, an effectively used space cannot be provided between the fly-wheel k and the fly-wheel magneto cover r.

The fly-wheel k, mounted to the protruding portion at the top end of the vertical crank shaft h, is a big factor in determining the overall height and weight of the multi-cylinder engine g. However, since the fly-wheel k is tall overall, it is difficult for each of the disclosed outboard motors to be compact and light and to have its center of gravity disposed at a low position.

In the outboard motors disclosed in JP '792 and JP '893, the inlet path in the engine cover is not separately formed from the engine compartment which includes the heat-generating sources. Therefore, the engine inlet path opens into the engine compartment. In addition, a forcible-supply-and-exhaust structure is not used in the engine compartment.

For this reason, air warmed in the engine compartment is guided to the engine air-inlet system, as a result of which air density is reduced, thereby reducing engine output and preventing heat in the engine compartment from being effectively exhausted. Therefore, overheating of the parts in the engine compartment is not sufficiently prevented. Consequently, for example, the operation of the parts in the engine compartment, such as electrical parts, is impaired, and it is difficult to ensure durability of the parts.

In the outboard motors disclosed in JP '952, JP '167, and JP '397, the fly-wheel is tall overall, and thus, is heavier. Therefore, the fly-wheel cannot be made lighter and the position of its center of gravity cannot be lowered, as a result of which it is difficult to make the outboard motors compact and light.

Since a boss that does not contribute to the inertia of the fly-wheel is formed in the fly-wheel, the fly-wheel is heavier, and the distance to the center of gravity of the fly-wheel from the top end supporting portion (bearing) of the crank shaft is increased. The larger the distance to the center of gravity of the fly-wheel from the top-end supporting portion of the crank shaft due to the position of the center of gravity of the fly-wheel being high, there is a greater chance that slight variations in rotational balance of the fly-wheel increase vibration. Therefore, a load is exerted upon the crank shaft and bearing more than is necessary, thereby increasing vibration of the crank shaft, impairing durability of the crank shaft, and damaging the crank shaft.

SUMMARY OF THE INVENTION

Accordingly, it is an object of the present invention to provide an outboard motor which includes an engine inlet path and an engine compartment that are independently formed to effectively and forcibly ventilate the engine compartment, thereby making it possible to prevent overheating in the engine compartment and maintain the density of combustion air at a sufficient value, so that engine output is increased.

It is another object of the present invention to provide an outboard motor which, by vigorously ventilating the inside of an engine compartment, makes it possible to effectively prevent overheating of parts in the engine compartment and to stably maintain the operation of the parts in the engine compartment, so that the parts are durable for a longer time and have increased life.

It is still another object of the present invention to provide an outboard motor which includes a fly-wheel that is short overall, is lightened, has its center of gravity disposed at a low position, and has a large inertia even if it is lightened, and which makes it possible to prevent changes in load in a low-speed rotation region by accommodating variations in rotation of an engine as a result of rotationally balancing and stably rotating the fly-wheel.

It is still another object of the present invention to provide a compact outboard motor which includes a fly-wheel magneto device that is lightened, that has its center of gravity disposed at a low position, and that provides high electrical power generation output and is designed with greater freedom while reducing the overall height of the fly-wheel magneto device.

It is still another object of the present invention to provide an outboard motor which includes a fly-wheel that is lightened, has its center of gravity disposed at a low position, and has a large inertia, which makes it possible to smooth out variations in torque each time combustion in an engine occurs on the one hand, and to effectively and efficiently prevent overheating of parts in an engine compartment in order to stably maintain operational functions of the parts in the engine compartment over a long period of time and, thus, to increase their lives on the other.

To overcome the aforementioned problems, according to an aspect of the present invention, there is provided an outboard motor including a vertical multi-cylinder engine, a fly-wheel magneto device, a partition plate, and a ventilation fan. The vertical multi-cylinder engine is disposed in an engine cover and includes a crank case and a crank shaft, the crank shaft being rotatably disposed and protruding upward from the crank case. The fly-wheel magneto device is disposed on the protruding portion of the crank shaft. The partition plate is disposed in the engine cover and partitions the inside of the engine cover into an engine air-inlet space and a space including a heat-generating source, the engine air-inlet space being disposed at the upper portion of the engine cover, and the space including a heat-generating source being disposed at the lower portion of the engine cover. The ventilation fan is disposed in the lower space below the partition plate.

According to another aspect of the present invention, there is provided an outboard motor including a vertical multi-cylinder engine and a fly-wheel magneto device. The vertical multi-cylinder engine is disposed in an engine cover, and includes a crank case and a crank shaft, the crank shaft being rotatably disposed and protruding upward from the crank case. The fly-wheel magneto device is disposed on the protruding portion of the crank shaft, and includes a ventilation fan having a centrifugal fan structure. The ventilation fan has an inlet that opens into an engine compartment, and has an exhaust opening that communicates with an exhaust opening of the engine cover.

According to another aspect of the present invention, there is provided an outboard motor including a vertical multi-cylinder engine and a fly-wheel magneto device. The vertical multi-cylinder engine is disposed in an engine cover, and includes a crank case and a crank shaft, the crank shaft being rotatably disposed and protruding upward from the crank case. The fly-wheel magneto device is disposed on the protruding portion of the crank shaft and includes a ventilation fan having a centrifugal fan structure. The inside of the engine cover is divided into an engine air-inlet space, disposed at an upper portion of the engine cover, and an engine compartment, disposed at a lower portion of the engine cover, with a partition plate being used to divide the inside of the engine cover. The ventilation fan has an inlet that opens into the engine compartment, and an exhaust opening that communicates with an exhaust opening of the engine cover.

According to another aspect of the present invention, there is provided an outboard motor including a vertical multi-cylinder engine and a fly-wheel magneto device. The vertical multi-cylinder engine is disposed in an engine cover, and includes a crank case and a vertical crank shaft, the crank shaft being rotatably disposed and protruding upward at the upper end from the crank case. The fly-wheel magneto device is disposed on the protruding portion of the crank shaft, and includes a fly-wheel and a magneto device having an electrical power generating function. The fly-wheel is joined to an outer peripheral flange of the protruding portion at the upper end of the vertical crank shaft, with the joining structure including a centering location.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which.

DESCRIPTION OF THE PREFERRED EMBODIMENTS

Figure 1:
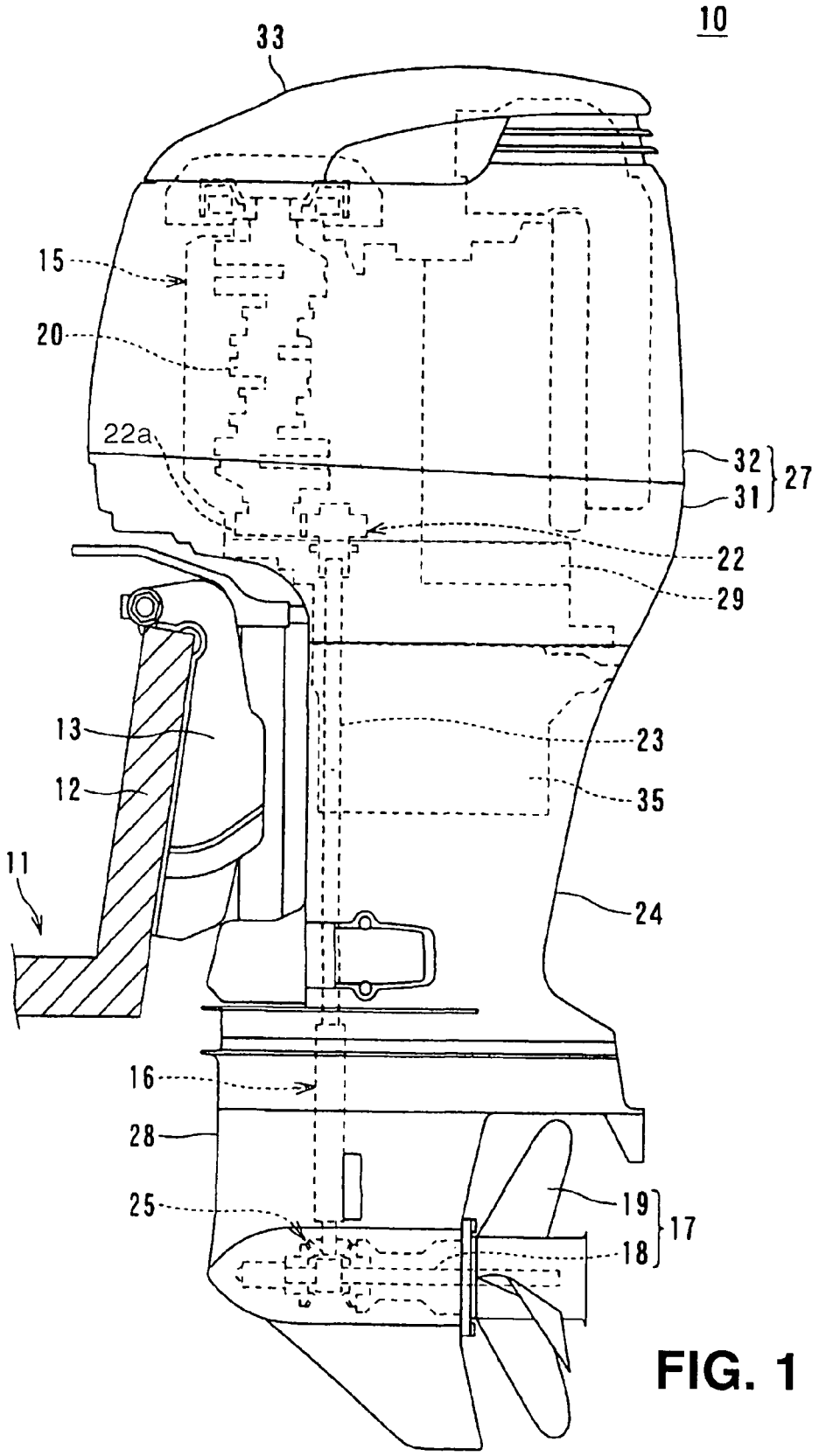
FIG. 1 is an overall schematic side view of an outboard motor of an embodiment of the present invention.

FIG. 1 is an overall schematic left side view of an outboard motor of an embodiment of the present invention. An outboard motor 10 is mounted to a transom 12 of a hull 11 through a mounting bracket 13 so as to freely face upward and downward. The outboard motor 10 comprises a V-type vertical multi-cylinder engine 15. Output from the V-type multi-cylinder engine 15 is transmitted to a propulsion device 17 through a power transmission device 16. The propulsion device 17 comprises a propeller shaft 18, to which engine output is transmitted, and a propeller 19, which is secured to the propeller shaft 18.

The V-type multi-cylinder engine 15 is a vertical engine having a vertical crank shaft 20 disposed substantially vertically therein. Engine output from the lower end of the crank shaft 20 is taken out. The lower end of the crank shaft 20 is operationally connected to the upper end of a drive shaft 23 through a primary gear device 22. The drive shaft 23 extends substantially vertically downward in a body housing 24. The lower end of the drive shaft 23 is operationally connected to the propeller shaft 18 through a bevel gear device 25, serving as a power change-over gear device. By changing the state of engagement of the bevel gear device 25 as a result of operating a shifting device (not shown), the propeller 19 is reversibly rotated in order to move the hull 11 forward and backward. The power transmission device 16 comprises the primary gear device 22, the drive shaft 23, and the bevel gear device 25.

The outboard motor 10 comprises an engine cover 27, disposed in a liquid-tight manner at the top portion of the body housing 24, and a gear case 28, disposed in a liquid-tight manner at the bottom portion of the body housing 24. An engine holder 29 and the V-type multi-cylinder engine 15 are accommodated in the engine cover 27. The V-type multi-cylinder engine 15 is disposed at the top portion of the engine holder 29.

The engine cover 27 is assembled in a liquid-tight manner so that it is dividable vertically into three parts, a lower engine cover portion 31, an upper engine cover portion 32, and a top engine cover portion 33. The engine holder 29 is accommodated in the lower engine cover portion 31. The mounting bracket 13, used to mount the outboard motor 10 to the hull 11, is mounted to the engine holder 29.

An oil pan 35 is disposed below the engine holder 29, and is accommodated in the body housing 24. The oil pan 35 may be formed at the top portion of the body housing 24 to form a part of the body housing 24. The body housing 24 accommodates the drive shaft 23 of the power transmission device 16 so that it is insertable vertically. The gear case 28 is disposed in a liquid-tight manner at the bottom portion of the body housing 24. The bevel gear device 25 is accommodated in the gear case 28.

Figure 2:
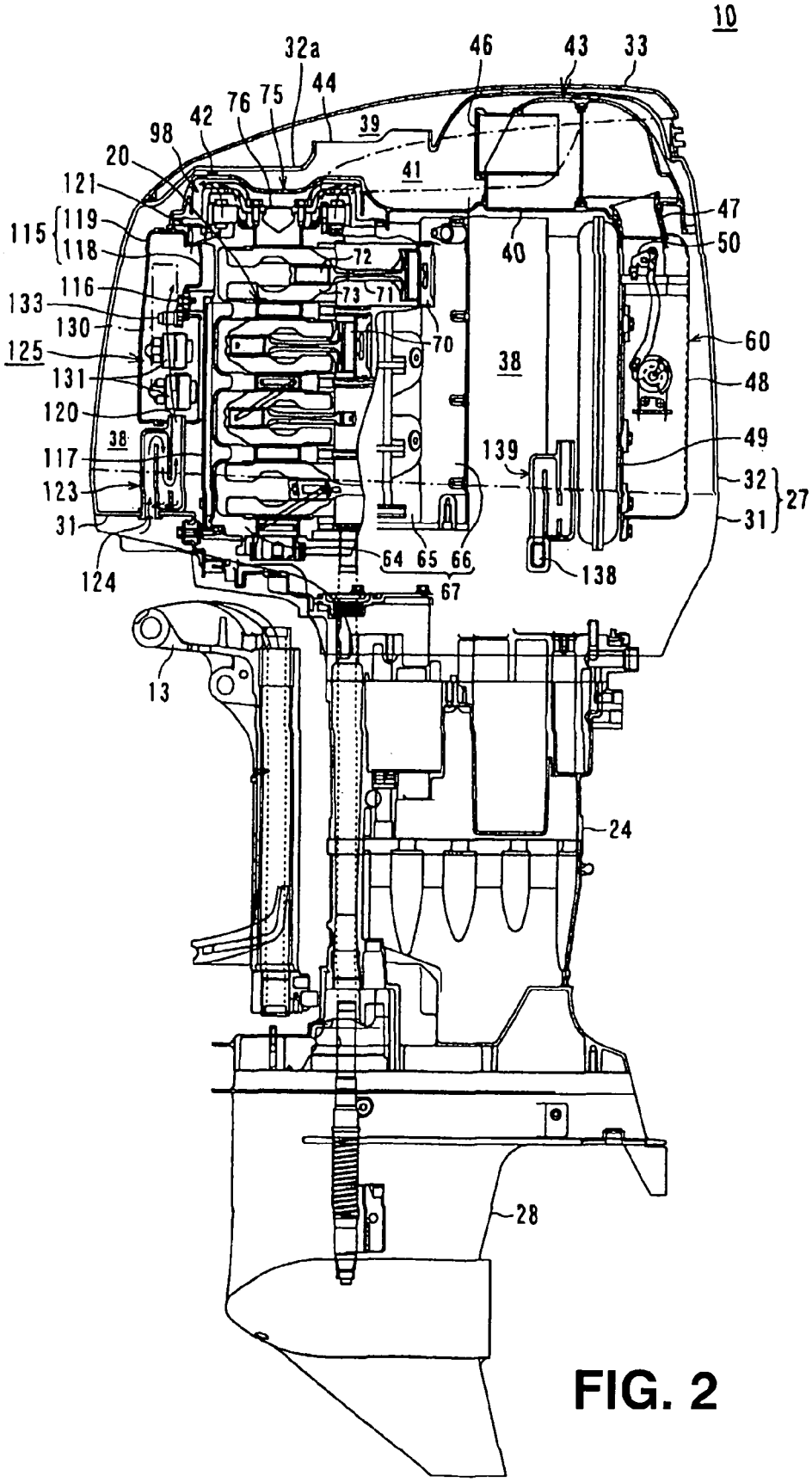
FIG. 2 is a side view of the outboard motor of the embodiment of the present invention shown in FIG. 1, with a V-type multi-cylinder engine installed in the outboard motor being partly shown in cross section.
Figure 3:
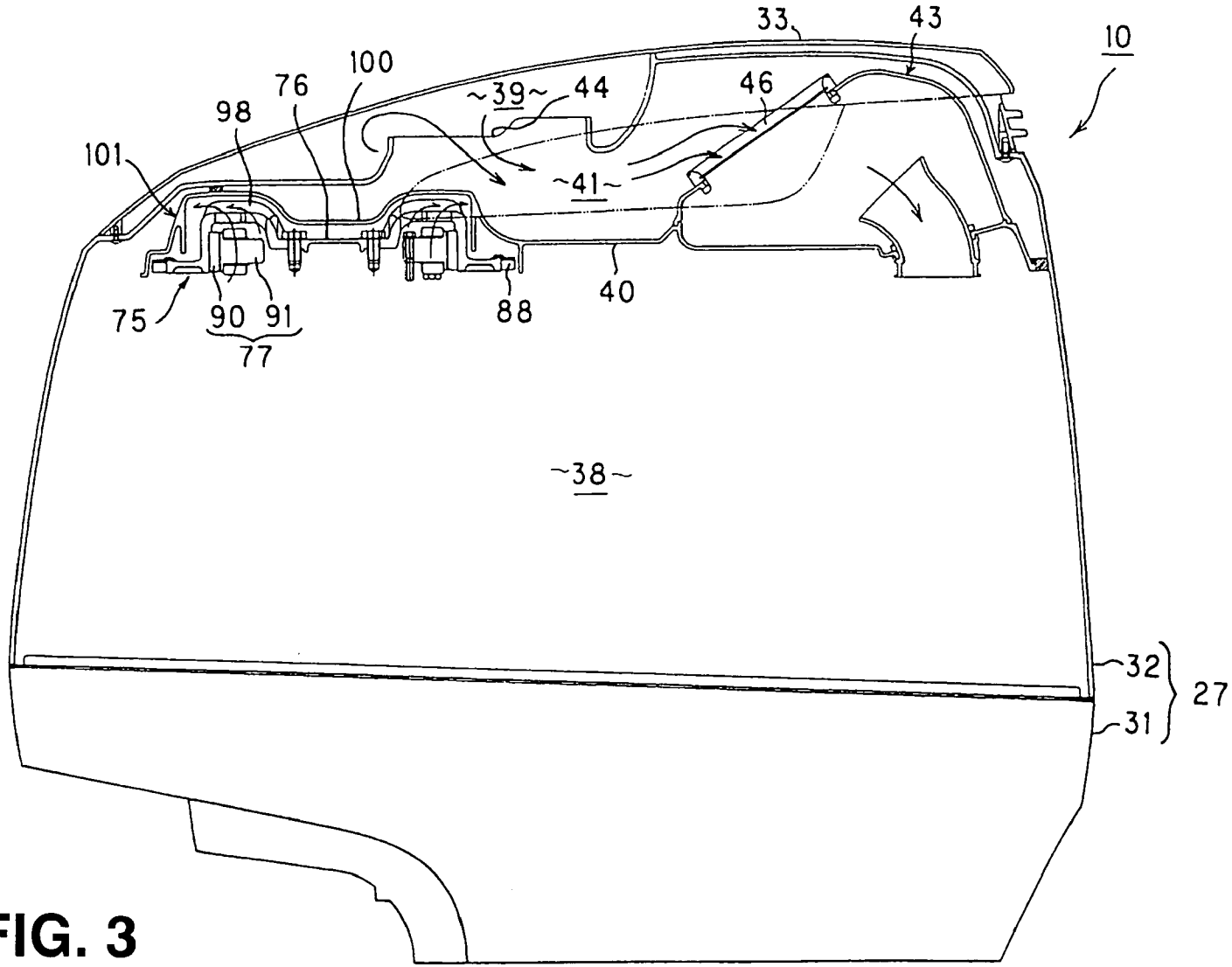
FIG. 3 is a partial cross-sectional view of a chamber structure in an engine cover of the outboard motor of the present invention.

As shown in FIGS. 2 and 3, the inside of the engine cover 27 of the outboard motor 10 is roughly divided vertically into an engine compartment 38 and an air inlet chamber 39, serving as a primary separator for engine intake. The engine compartment 38 is formed by the lower engine cover portion 31 and the upper engine cover portion 32. The V-type multi-cylinder engine 15, which is, for example, an 8-cylinder, 4-cycle engine, is accommodated in the engine compartment 38.

An air-tight or liquid-tight partition plate 40 is disposed as a partition cover below a top portion 32*a* of the upper engine cover portion 32. By the partition plate 40, the inside of the engine cover 27 is divided off into an engine inlet space (upper portion) and a space including heat-generating sources (lower portion). A downstream air-inlet chamber 41, serving as a secondary separator, is formed between the partition plate 40 and the top portion 32*a* of the upper engine cover portion 32. An intake silencer 43 is disposed in the downstream air-inlet chamber 41.

The intake silencer 43 is formed with a water entry prevention structure by disposing a box-shaped casing at the upper surface of the partition plate 40. A gap between the partition plate 40 and the upper engine cover portion 32 is sealed in an air-tight manner by a sealant 42, which is a resilient member formed of a resilient material, for example urethane or sponge, so that it divides the engine cover 27 into the downstream air-inlet chamber 41 (upper portion) and the engine compartment 38.

Figure 4:
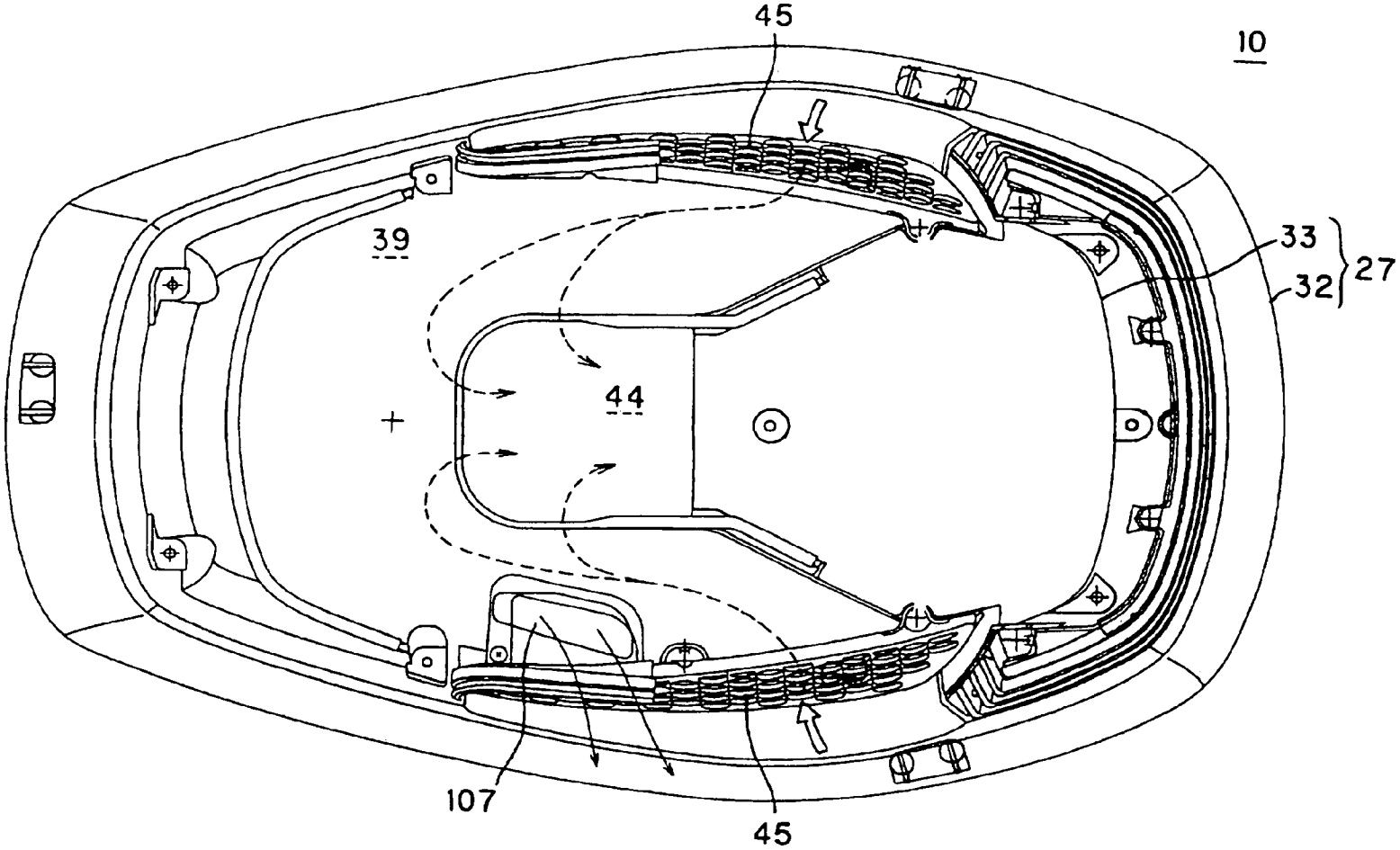
FIG. 4 is a plan view of the outboard motor of the present invention.
Figure 5:
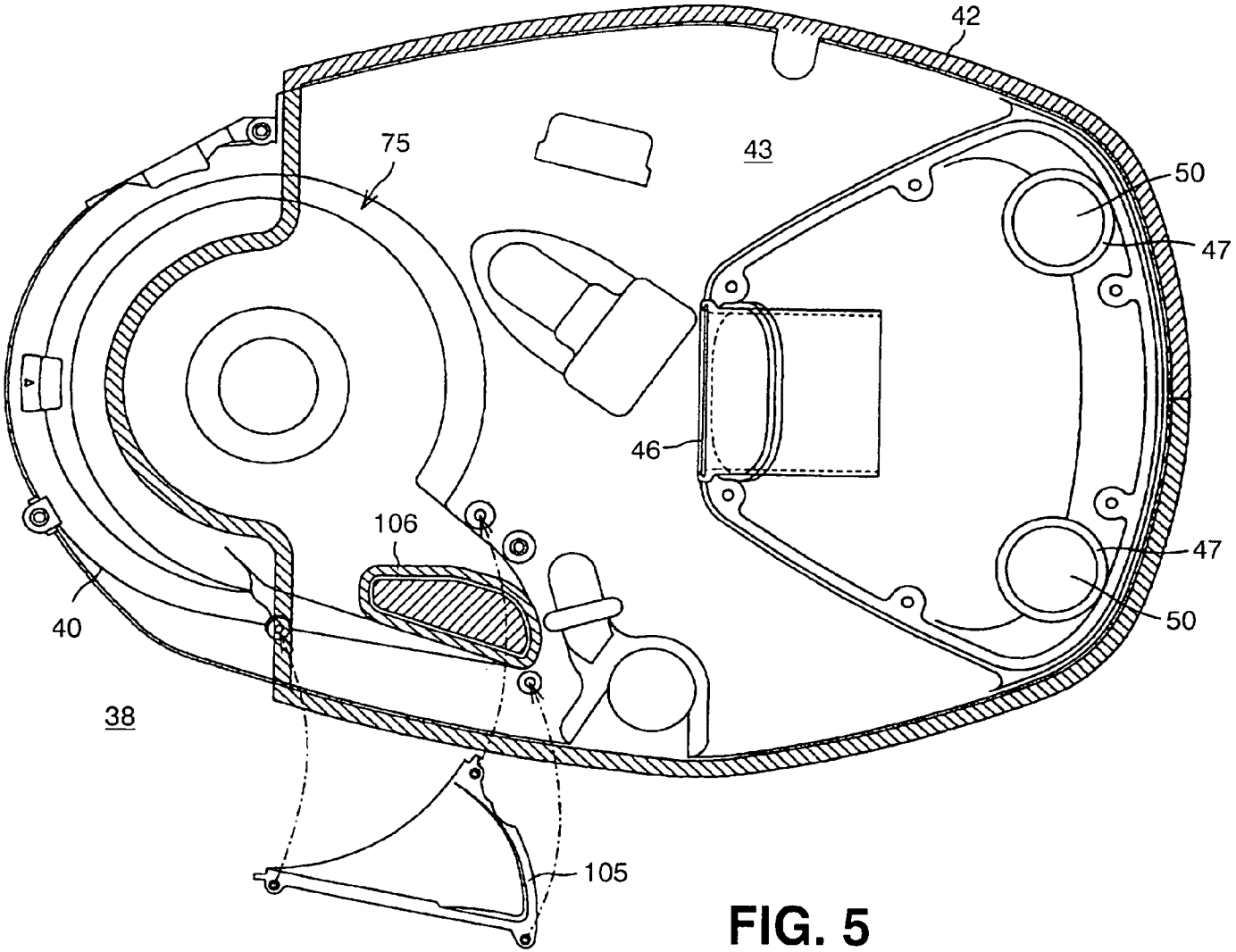
FIG. 5 is a plan view of a partition plate without an upper engine cover portion of the outboard motor of the present invention.

The air-inlet chamber 39, which is formed between the top engine cover portion 33 and the upper engine cover portion 32, communicates with the downstream air-inlet chamber 41 through a communication opening 44, which is formed at substantially the central portion of the top portion 32*a* of the upper engine cover portion 32. As shown in FIG. 4, a pair of left and right fresh air inlets 45 for engine air suction are disposed, one at the left portion and one at the right portion of the top engine cover portion 33. The fresh air inlets 45 are formed by forming many holes or slits in the side portions of the top engine cover portion 33.

Outside air that flows in from the fresh air inlets 45 of the top engine cover portion 33 flows into the air inlet chamber 39, which forms the engine inlet space, and has its direction of flow in the air inlet chamber 39 changed in order to separate moisture and foreign matter from the air. The outside air that has foreign matter and moisture removed therefrom passes through the communication opening 44, is guided to the downstream air inlet chamber 41, defined by the top portion 32*a* of the upper engine cover portion 32 and the partition plate 40, and is further subjected to gas liquid separation in the air inlet chamber 41. The outside air that is subjected to gas liquid separation is guided to the intake silencer 43 through an intake opening 46. The intake silencer 43 causes the outside air to expand to absorb noise, so that the pressure of the intake noise is reduced.

Figure 6:
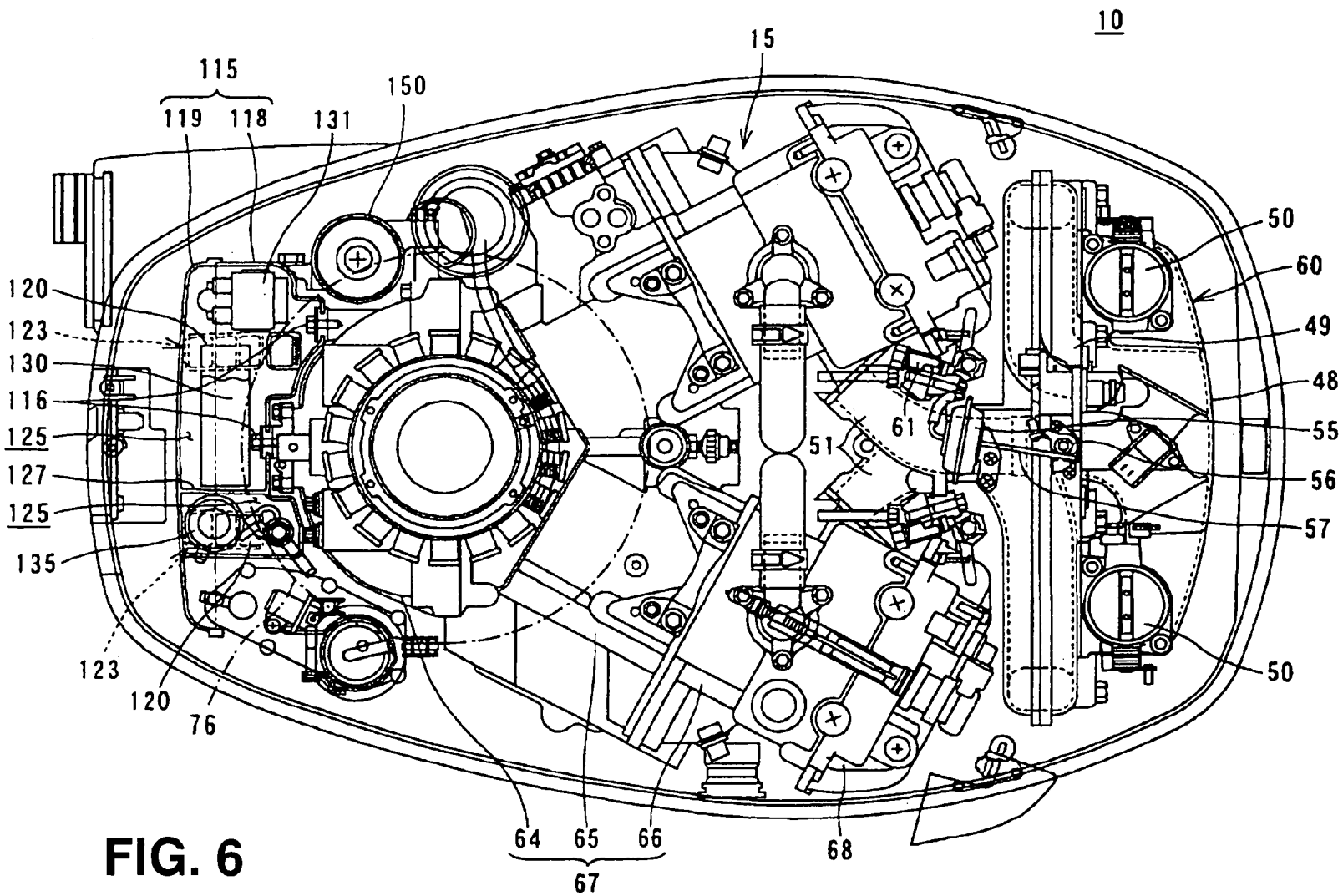
FIG. 6 is a plan view of the V-type multi-cylinder engine mounted without the partition plate in the outboard motor of the present invention.

As shown in FIG. 6, after the noise has been absorbed using the intake silencer 43, the outside air is guided to an engine air-inlet system 60, which is independently formed in the engine compartment 38. More specifically, the outside air is guided to a surge tank 48, which is a throttle body, via a funnel 47, which is disposed at the partition plate 40. From the surge tank 48, the outside air is guided to an intake manifold 49. A butterfly valve 50 is disposed as a throttle valve in an intake path near the funnel 47. The outside air that is divided by the intake manifold 49 becomes intake air for combustion and passes through each intake pipe 51, so that the intake air is supplied to each cylinder of the V-type multi-cylinder engine 15.

A diaphragm actuator 55, which comprises a path change-over device that can change the length of an intake path, is disposed at the intake manifold 49 or the intake pipes 51. The diaphragm actuator 55 communicates with the downstream side of the throttle valve and operates in accordance with negative intake air pressure in the engine, and is also operationally connected to a variable intake valve 56 through an operating rod 57 to adjust the opening and closing of the variable intake valve 56. By the operation of the variable intake valve 56, the length of the intake path in the intake manifold 49 is changed, so that the length of the intake path varies in accordance with the output from the V-type multi-cylinder engine 15.

The diaphragm actuator 55 is connected to an intake negative pressure portion, disposed downstream from the throttle valve, through a solenoid valve (not shown), which is controlled by an engine controlling unit. By operating the diaphragm actuator 55 as a result of opening and closing the solenoid valve in such a way that the variable intake valve 56 changes the length of the intake path so that, when the throttle valve is fully opened at a large opening angle when the V-type multi-cylinder engine 15 is operating at medium or high speed, the length of the intake path in the intake manifold 49 is shortened, and, when the V-type multi-cylinder engine 15 is idling or operating at low speed, the length of the intake path is increased.

The engine inlet space, formed by the air-inlet chambers 39 and 41 and the intake silencer 43, and the engine air-inlet system 60, formed by the surge tank 48, the intake silencer 49, the butterfly valve 50, serving as a throttle valve, and the intake pipes 51, are independently formed in the engine cover 27. The intake silencer 43 and the surge tank 48 of the engine air-inlet system 60 are disposed vertically at the back end of the engine compartment 38. Fuel is injected from a fuel injector 61 into an intake air passing through the intake pipes 51 of the engine air-inlet system 60 and becomes an air-fuel mixture, which is supplied to the V-type multi-cylinder 4-cycle engine 15.

The V-type multi-cylinder engine 15 also comprises a crank case 64, an engine block 67, a cylinder block 65, and a pair of left and right cylinder heads 66. The cylinder block 65 is integrally assembled with the crank case 64 and is V-shaped in plan view. The cylinder heads 66 are integrally formed with the cylinder block 65. A cylinder head cover 68 is mounted to the cylinder heads 66. The crank case 64 is assembled so that it can be divided in the forward and backward directions by a plane passing through the axial center of the crank shaft 20.

As shown in FIG. 2, a piston 70 is slidably accommodated in a chamber formed by the cylinder block 65. The piston 70 is operationally connected to a crank web 73 through a connecting rod 71 and a crank pin 72. The crank web 73 is integrally connected with a shaft portion to form the vertical crank shaft 20. The crank shaft 20 is vertically placed in the crank case 64 so as to be rotatable.

The crank shaft 20 penetrates the top portion of the crank case 64 and protrudes upwardly therefrom. A fly-wheel magneto device 75 is disposed at the top end portion of the protruding portion of the crank shaft 20. The lower portion of the crank shaft 20 penetrates the bottom portion of the crank case 64 and protrudes therefrom. A drive gear 22*a* of the primary gear device 22 is disposed at the lower end portion of the protruding portion of the crank shaft 20.

Figure 7:
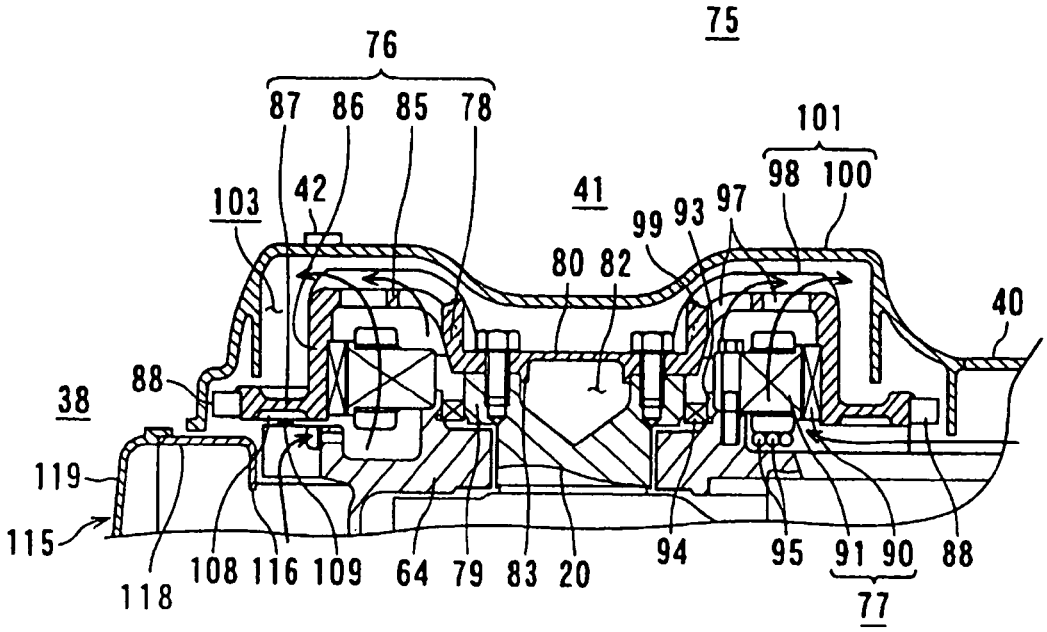
FIG. 7 is a sectional side view of the structure of a fly-wheel magneto device of the outboard motor of the present invention.

The fly-wheel magneto device 75 has the sectional structure shown in FIGS. 2 and 7. The fly-wheel magneto device 75 comprises a fly-wheel 76 and a magneto device 77 which generates electrical power. As a whole, the fly-wheel 76 has the shape of an inverted plate (ashtray) or a hat, which is close to a disk shape.

The fly-wheel 76 is formed using, for example, a mold. It is a molded product that is heavy and has a large inertia. A disk-shaped mounting portion 78 is formed in a depressed manner in the central portion of the fly-wheel 76. The fly-wheel 76 is secured to an outer peripheral flange 79 of the vertical crank shaft 20 with, for example, bolts, so as to cover it from above it. The outer peripheral flange 79 of the vertical crank shaft 20 has a large diameter. A considerable portion is removed in the axial direction from the central portion of the top portion and is lightened. When the top surface of the outer peripheral flange 79, which is formed at the protruding portion at the top end of the crank shaft 20, is defined as the mounting surface, a large mounting area can be provided, so that the fly-wheel 76 can be stably secured. The fly-wheel 76 has the function of a magneto rotor for generating electrical power in addition to smoothing out variations in engine torque and storing kinetic energy resulting from a large moment of inertia.

A thin-walled cover 80 for covering the removed portion of the crank shaft 20 is formed at the central portion of the disk-shaped mounting portion 78. Therefore, it is not necessary to perform rust prevention treatment on a hole 82, formed by removing the considerable portion from the central portion of the top portion, and, thus, the crank shaft 20 has a reduced weight. The cover 80 prevents entry of water into the removed portion.

An annular protrusion 83 of the fly-wheel 76 is fitted to the hole 82 of the outer peripheral flange 79 as a centering location and is joined thereto, thereby allowing centering of the fly-wheel 76.

Figure 8:
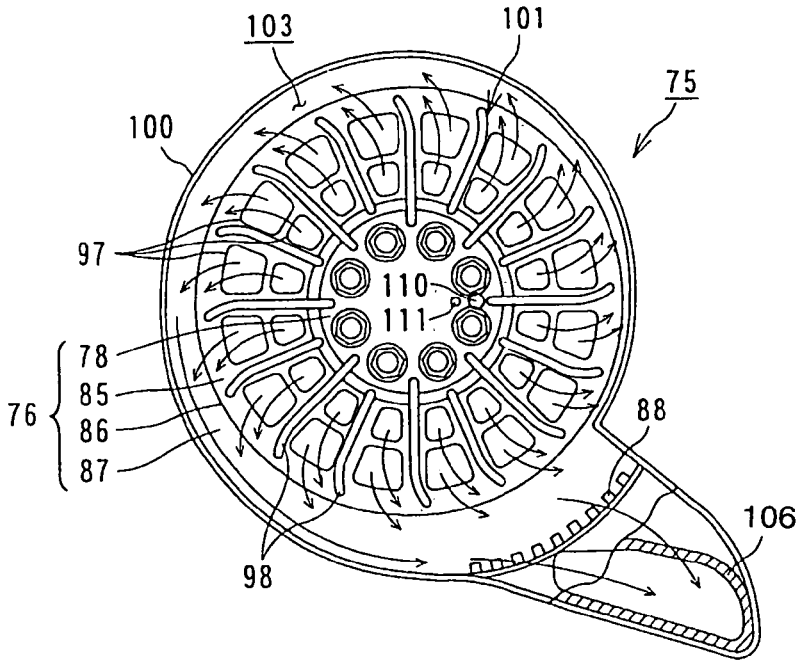
FIG. 8 is a plan view of the structure of a ventilation fan of the fly-wheel magneto device shown in FIG. 7.

As shown in FIGS. 7 and 8, the fly-wheel 76 comprises the central disk-shaped mounting portion 78, a curved plate 85, a sleeve 86, and an outer peripheral flange 87. The curved plate 85 forms an intermediate area from the disk-shaped mounting portion 78. The sleeve 86 extends vertically downward from the outer peripheral end of the curved plate 85. The outer peripheral flange 87 cross-sectionally extends radially outward and substantially horizontally from the lower portion of the sleeve 86. A ring gear 88 is disposed at the outer periphery of the outer peripheral flange 87. The ring gear 88 increases the inertia of the fly-wheel 76, and is such as to start the V-type multi-cylinder engine 15 by engaging a drive gear of a starter motor (not shown).

The magneto device 77 is disposed at the inner peripheral side of the sleeve 86 of the fly-wheel 76. The magneto device 77 comprises a magneto rotor 90 and a magnet stator 91. The magneto rotor 90 comprises a magnet and is secured to the inner peripheral side of the sleeve 86. The magnet stator 91 is concentrically disposed at the inner peripheral side of the magneto rotor 90. Rotation of the fly-wheel 76 causes AC power to be generated in a stator coil of the magnet stator 91. The magnet stator 91 has a toroidal or annular shape, and is secured to a mounting surface of the top portion of the crank case 64. In the fly-wheel magneto device 75, in order to lower the position of the center of gravity of the fly-wheel 76 while providing an electrical power generating function in a low-speed engine rotation area, the inside and outside diameters of the stator coil of the magneto device 77 are made large. Accordingly, the vertical height of the stator coil is reduced to reduce its thickness.

An upwardly protruding sleeve-shaped or annular protrusion 93 is formed as a centering location at the stator mounting surface of the crank case 64. The magneto stator 91 is fitted to and positioned at the sleeve-shaped protrusion 93, thereby allowing centering of the magnet stator 91. An oil seal 94 is disposed between the sleeve-shaped protrusion 93 of the crank case 64 and the outer peripheral flange 79 of the vertical crank shaft 20. The oil seal 94 is disposed near the magnet stator 91 (magnet stator coil) of the magneto device 77.

The magneto device 77 has the function of generating electrical power. AC power that is generated by rotation of the magneto rotor 90 is generated in a generator (power generating) coil 95, which is the magnet stator coil, so that AC power can be carried outside. By disposing the mounting portion of the fly-wheel 76 in a depressed manner, the top portion of the magnet stator coil is disposed above the mounting surface of this mounting portion or the mounting surface of the top portion of the crank shaft 20. In addition, by disposing the mounting portion of the fly-wheel 76 in a depressed manner, even if the mounting portion is secured to the crank shaft 20 by tightening (fastening) bolts, the heads of the fastening bolts will not protrude upward from the curved plate 85 of the fly-wheel 76.

In the fly-wheel 76, the curved plate 85 has a plurality of vent holes 97 that are disposed in the peripheral direction, and a plurality of ventilation fins 98 that are disposed in the form of ribs on the upper side so as to extend radially outward. The vent holes 97 penetrate and open between the ventilation fins 98.

By disposing the plurality of vent holes 97 in the curved plate 85 of the fly-wheel 76, it is possible to considerably lighten the intermediate region of the fly-wheel 76. Even if the fly-wheel 76 is light, the fly-wheel 76 is strengthened, that is, physically and mechanically strengthened, by disposing the plurality of ventilation fins 98 integrally formed with the curved plate 85. The ventilation fins 98 are the fins of a ventilation fan 101 and are members for providing physical and mechanical strength. The mechanical and physical strength of the fly-wheel 76 can be increased even more by disposing a reinforcing rib 99 in the form of a ring and in a standing manner at the inner peripheral side of the curved plate 85. The reinforcing rib 99 integrally joins the inner peripheral sides of the ventilation fins 98.

In the outboard motor 10, in order to lower the position of the center of gravity of the fly-wheel 76 while the fly-wheel magneto device 75 provides the function of generating electrical power in a low-speed engine rotation area, the fly-wheel 76 has a flat structure with a large diameter. By forming the fly-wheel 76 with a large diameter, it is possible for the fly-wheel 76 to have a large moment of inertia while the outer peripheral portion thereof that contributes to inertia has sufficient weight. In addition, by forming the fly-wheel 76 with a large diameter, it is possible to increase the inside and outside diameters of the stator coil of the magneto device 77 and reduce the thickness of the stator coil. By increasing the outside diameter of the stator coil, even if the number of rotations is the same, the peripheral speed of the magneto rotor (magnet) 90 facing the stator coil is increased, so that electrical power generation in a low-speed rotation area is increased. By increasing the area of the stator coil, the stator coil can be made thin.

The fly-wheel 76 is covered by the fly-wheel magneto cover 100 from above, so that the ventilation fan 101 is formed by wall surfaces (top wall surface and peripheral side wall surface) of the fly-wheel magneto cover 100 and the ventilation fins 98 of the fly-wheel 76. The fly-wheel magneto cover 100 comprises a fan casing of the ventilation fan 101. The fly-wheel magneto cover 100 is formed integrally with the partition plate 40, and forms part of the partition plate 40.

The ventilation fan 101 prevents overheating in the engine compartment 38, and forcibly cools electrical parts. As shown in FIG. 8, the ventilation fan 101 is formed with a centrifugal fan structure that forms a spiral path 103 between the fly-wheel magneto cover 100 and the fly-wheel 76.

Figure 9:
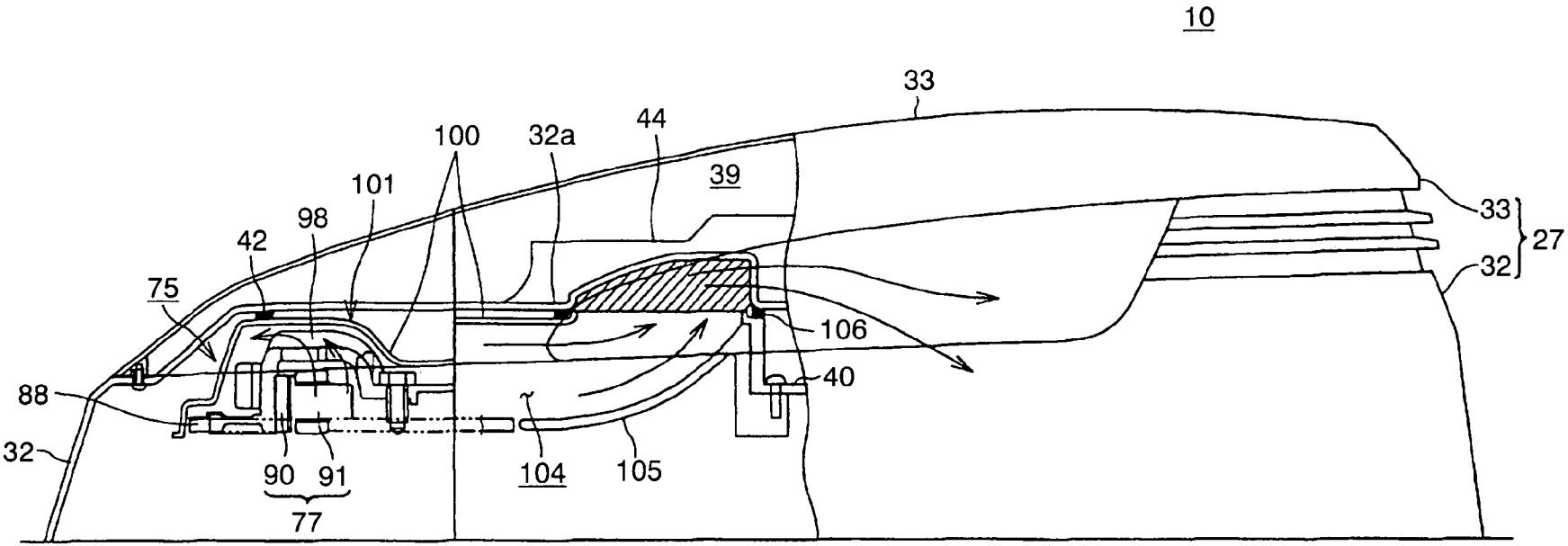
FIG. 9 is a side view, partly in cross section, of the fly-wheel magneto device and the ventilation fan incorporated in the outboard motor of the present invention.

As shown in FIGS. 8 and 9, the fly-wheel cover 100, which forms part of the partition plate 40, is additionally provided with an exhaust path 104, serving as an exhaust inducing path, which extends obliquely upward and radially outward from a portion of the fly-wheel cover 100 in a peripheral direction. The exhaust path 104, formed by the top portion 32*a* of the upper engine cover portion 32 and a guide plate 105, is connected to an exhaust opening 107 (see FIG. 4) of the top engine cover portion 33. The exhaust opening 107 opens near one of the fresh-air inlets 45.

Although, in the example shown in FIG. 4, the exhaust opening 107 is disposed forwardly and upwardly of the left fresh-air inlet 45, the position of the exhaust opening 107 is not limited thereto. The exhaust opening 107 may be disposed near, desirably, rearwardly and upwardly of, the fresh-air inlet 45. When the exhaust opening 107 is disposed forwardly and upwardly of the fresh-air inlet 45, it is possible to shorten the exhaust path 104, so that the amount of heat dissipated in the engine inlet space can be reduced. The exhaust opening 107 is such that the area between the top portion 32*a* of the upper engine cover portion 32 and the fly-wheel cover 100 and the area between the top portion 32*a* of the upper engine cover portion 32 and the top engine cover portion 33 are hermetically sealed by a resilient seal 106.

In the fly-wheel magneto device 75 shown in FIG. 2 and FIGS. 7 to 9, the ventilation fan 101 is disposed at the top portion of the fly-wheel 76 in order to forcibly supply air into and exhaust air from the engine compartment 38 for ventilation, so that it is possible to vigorously and effectively prevent overheating of the parts in the engine compartment 38.

Here, since the thin-walled cover 80 is disposed at the recessed mounting portion at the central portion, and the vent holes 97 are formed in the curved plate 85, disposed at the outer periphery of the thin-walled cover 80 to remove portions of the fly-wheel 76, the fly-wheel 76 can be made lighter as a whole. The fly-wheel 76 can be lightened by a few percent to 40 percent or more compared to the same type of related fly-wheel used in an outboard motor as a result of reducing its overall height. Even if the fly-wheel is lightened, it is possible for the moment of inertia of the fly-wheel 76 to be equal to or greater than that of a related fly-wheel. In the fly-wheel 76 shown in FIG. 7, it is possible to reduce its weight by approximately 25% and increase its moment of inertia by approximately 8%.

The fly-wheel 76 is made lighter by lightening the central portion and the inner radial portion, or intermediate area, of the fly-wheel 76, so that the outer peripheral portion of the fly-wheel 76 has a wall that is thicker and, thus, heavier than the thin-walled cover 80. Although the fly-wheel 76 is lightened, its outer peripheral portion is sufficiently heavy, so that the inertia of the fly-wheel 76 is large as a whole. Therefore, although the overall weight of the fly-wheel 76 is reduced by a few percent to 40 percent or more compared to a related fly-wheel, it is possible for the moment of inertia of the fly-wheel 76 to be equal to or greater than, for example, about 3% to about 10% greater than, the moment of inertia of a related fly-wheel, so that the fly-wheel 76 can have a large moment of inertia. The moment of inertia increases proportionally to the square of the distance from the rotational center.

Figure 11:
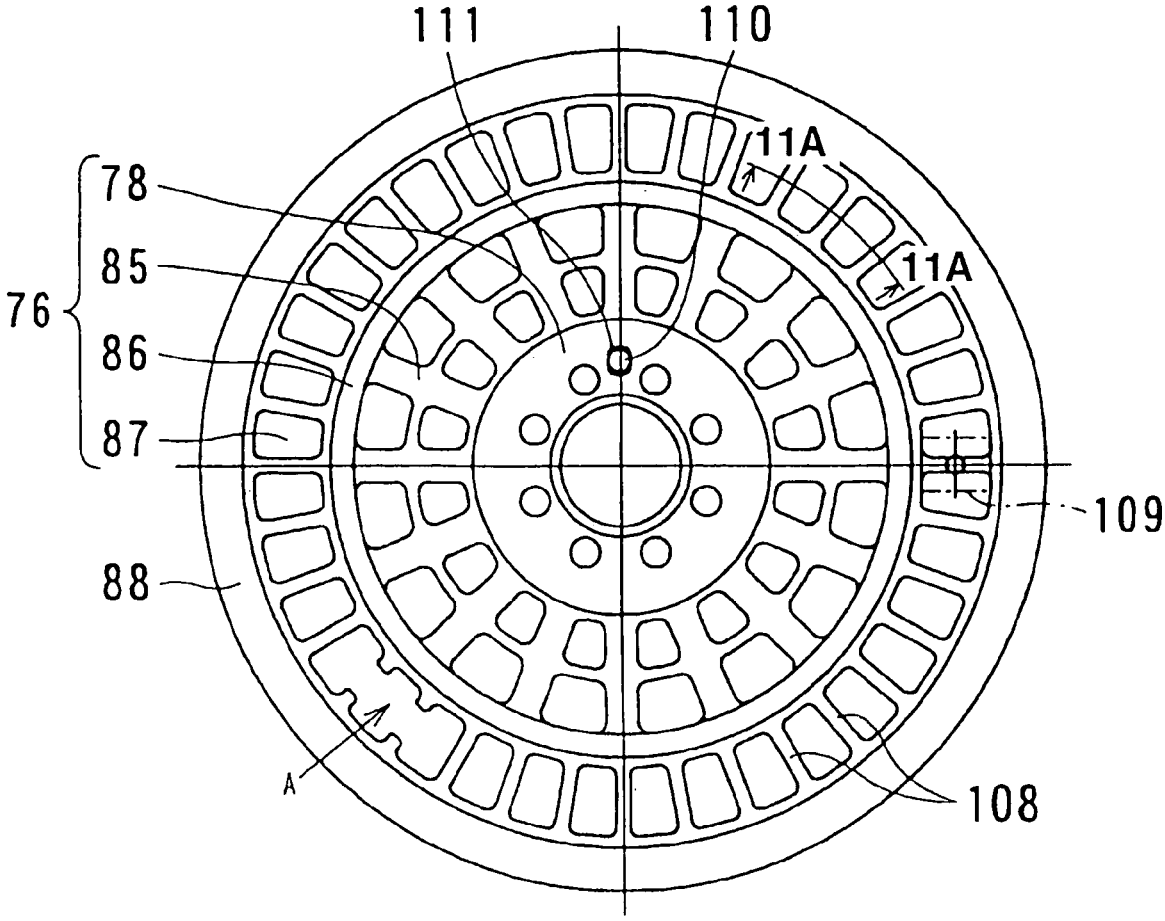
FIG. 11 is a bottom view of a fly-wheel having the ventilation fan shown in FIG. 10.
Figure 11A:
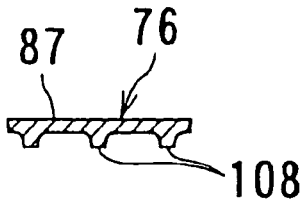
FIG. 11A is a sectional view of the fly-wheel taken along line 11A—11A of FIG. 11.

The fly-wheel 76, which is flat and has a reduced overall height, can have a large diameter. Even if the fly-wheel 76 has a large diameter, the position of its center of gravity is lowered, and the fly-wheel 76 is stably mounted by joining it to the outer peripheral flange 79 having a large mounting area of the vertical crank shaft 20. Therefore, the fly-wheel 76 rotates smoothly, so that wavy movements of the fly-wheel 76 are prevented. Since the fly-wheel 76 rotates stably and smoothly, as shown in FIG. 11, the lower surface of the outer peripheral flange 87 of the fly-wheel 76 may be formed with a structure in which radial ribs 108 are disposed in a standing manner and formed as strengthening members serving as trigger poles.

By forming the ribs 108, which serve as strengthening members, radially at the lower surface of the outer peripheral flange 87 of the fly-wheel 76, it is possible for a crank angle sensor 109, which detects, for example, the rotational speed of the engine and the crank timing, to face the lower surface of the outer peripheral flange 87. The crank angle sensor 109 is disposed at the crank case 64. By causing the crank angle sensor 109 to face the ribs 108, disposed at the lower surface of the fly-wheel 76, in the vertical direction, the radial ribs 108 can be used as trigger poles. By forming the ribs 108 of the fly-wheel 76 at some portions of the fly-wheel 76, they may be used as references for detecting the crank angle.

The fly-wheel 76 can be formed with the shape of a flat disc as a whole, and it is possible to reduce the height (overall height) of the fly-wheel 76 and to lower the position of its center of gravity. Even if the fly-wheel 76 is made short, the fan path (spiral path) 103 of the ventilation fan 101 can be satisfactorily provided between the top and outer peripheral walls of the fly-wheel cover 100 and the fly-wheel 76. In addition, since the height of the fly-wheel 76 can be reduced, it is possible to lower the position of its center of gravity, so that the outboard motor 10 can be made compact and light without its overall height being increased.

Even if the fly-wheel 76 is short, the fly-wheel 76 can be stably mounted to the outer peripheral flange 79 having a large mounting area of the vertical crank shaft 20, so that the fly-wheel 76 is precisely and stably secured to the outer peripheral flange 79 of the crank shaft 20 by, for example, tightening (fastening) bolts. Even if there are variations in the tightening of the fastening bolts, by joining the fly-wheel 76 to the flange in a plane, the mounting height of the fly-wheel 76 does not change, so that it is stably and precisely secured in the vertical direction. In addition, since the annular protrusion (centering location) 83 is fitted to the hole 82 when the fly-wheel 76 is mounted to the crank shaft 20, the fly-wheel 76 is centered, so that the fly-wheel 76 is positioned and mounted more precisely in the radial and vertical directions. By this, it is not necessary to adjust the mounting position of the crank angle sensor 109 in the vertical direction.

Figure 10:
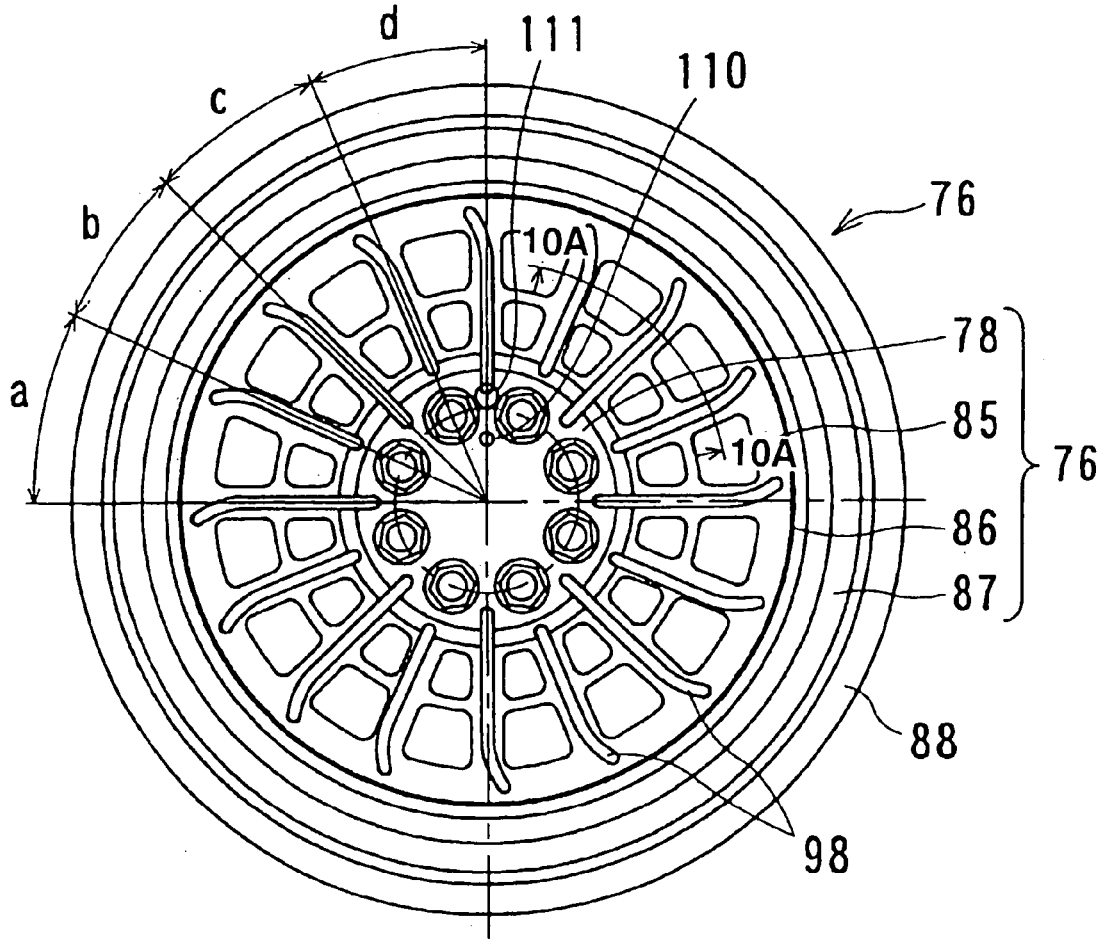
FIG. 10 is a plan view of the fly-wheel magneto device incorporated in the outboard motor of the present invention, with the arrangement of ventilation fins of the ventilation fan being shown.
Figure 10A:
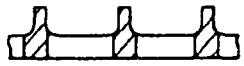
FIG. 10A is a sectional view of the fly-wheel magneto device taken along line 10A—10A of FIG. 10.

The ventilation fins 98 of the ventilation fan 101 are disposed in the form of ribs on the upper surface of the fly-wheel 76. As shown in FIG. 8, each ventilation fin 98 is faced in the radial direction in terms of the rotational center of the fly-wheel 76, and maintains the fly-wheel 76 in a properly rotationally balanced state. As shown in FIGS. 10 and 10A, the ventilation fins 98, which are directed in the radial direction, are formed so that adjacent ventilation fins 98 are disposed at unequal pitches of intervals a, b, c, and d in FIG. 10. By disposing adjacent ventilation fins 98 at unequal angular intervals, it is possible to prevent whistling that occurs when the ventilation fan 101 rotates.

The ventilation fins 98 of the ventilation fan 101 are disposed in the form of blades from the inner periphery to the outer periphery of the fly-wheel 76 at the unequal angular pitches, which are represented by reference characters a, b, c, and d in FIG. 10 as mentioned above, so that wind noise in a particular frequency range is prevented from being generated. The ventilation fins 98 shown in FIGS. 10 and 10A are such that each set of five consecutive ventilation fins 98 disposed at the intervals a, b, c, and d and in an area measuring 90 degrees forms a block, so that the fly-wheel 76 is divided into four blocks. Therefore, the ventilation fins 98 are disposed in such a manner as to allow the fly-wheel 76 to be easily balanced.

Although, in the example shown in FIGS. 10 and 10A, the ventilation fins 98 of the ventilation fan 101 that are disposed on the fly-wheel 76 at the unequal angular pitches a, b, c, and d are divided into four blocks, the ventilation fins 98 may be divided into six blocks by disposing them at the unequal angular pitches a, b, and c and in an area measuring 60 degrees, or they may be divided into eight blocks by disposing them at the unequal angular pitches a, b, and c and in an area measuring 45 degrees.

In FIGS. 8, 10, and 11, reference numeral 110 denotes a marker for disposing a recess or a protrusion at the disk-shaped mounting portion 78 of the fly-wheel 76. A positioning pin 111 is implanted in the lower surface of the fly-wheel 76 near the marker 110.

The positioning pin 111 is a knock pin for specifying the mounting angle of the fly-wheel 76. When the fly-wheel 76 has trigger poles, the knock pin becomes a reference for outputting a reference crank angle signal from the crank angle sensor 107 at a predetermined crank angle timing. A hole for implanting the knock pin 111 is a slotted blind hole, which is formed from the front surface of the fly-wheel 76. The hole is formed so that water does not reach the crank shaft 20 even if water enters the fly-wheel 76. A protrusion or depression is formed and marked with the marker 110 so that the position of the hole can be known when the fly-wheel 76 is being mounted. The knock pin 111 restricts the angular direction in the peripheral direction of the fly-wheel 76. By forming the hole into a slotted hole, the fly-wheel 76 can be mounted with greater angular precision.

In the outboard motor 10, as shown in FIG. 2, an electrical part box 115, formed of resin, is resiliently held in a raised state forwardly of the crank case 64 of the V-type multi-cylinder engine 15 by a resilient mount 116, such as a rubber mount. By resiliently holding the electrical part box 115, it can be made more resistant to vibration. Electrical part boxes 115 may be disposed on the left and right sides of the crank case 64 in the engine compartment 38. A cover 117 for externally covering the crank case 64 is disposed as a protective plate between the electrical part box 115 and the crank case 64.

The electrical part box 115 is a flat electrical part holder comprising a body 118 and a cover 119. Inlets 120 are formed in the bottom of the box and outlets 121 are formed in the top of the box.

Figure 12A:
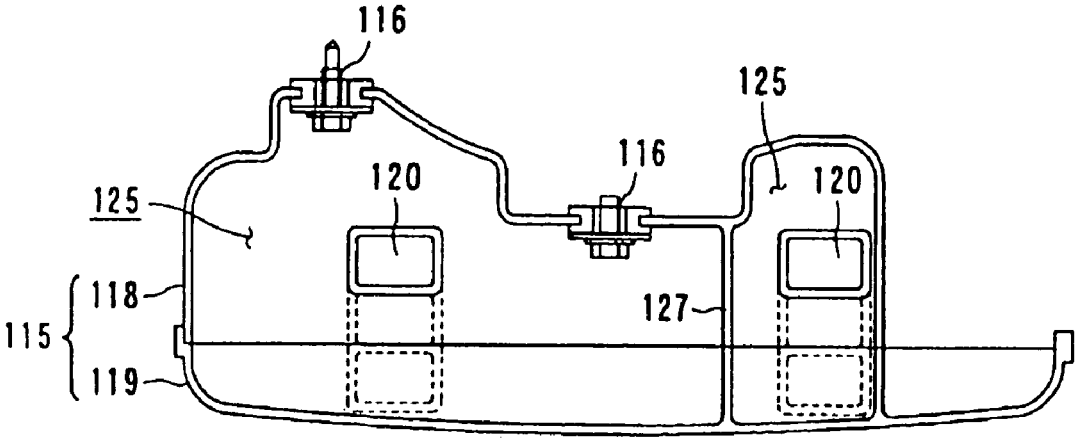
FIG. 12A is a sectional plan view of an electrical part box of the present invention.

As shown in FIG. 2 and FIG. 12A, the inlets 120 of the electrical part box 115 communicate with a ventilation fresh air inlet 124 through ventilation separators 123 having a zigzag path and a labyrinth structure. The fresh air inlet 124 opens downward into the lower surface of the lower engine cover portion 31, and prevents the entry of foreign matter, such as moisture. Foreign matter, such as moisture, that enters the fresh air inlet 124 is separated and removed from air by the ventilation separators 123. The removed moisture or other foreign matter falls downward and is exhausted out the outboard motor 10.

Figure 12B:
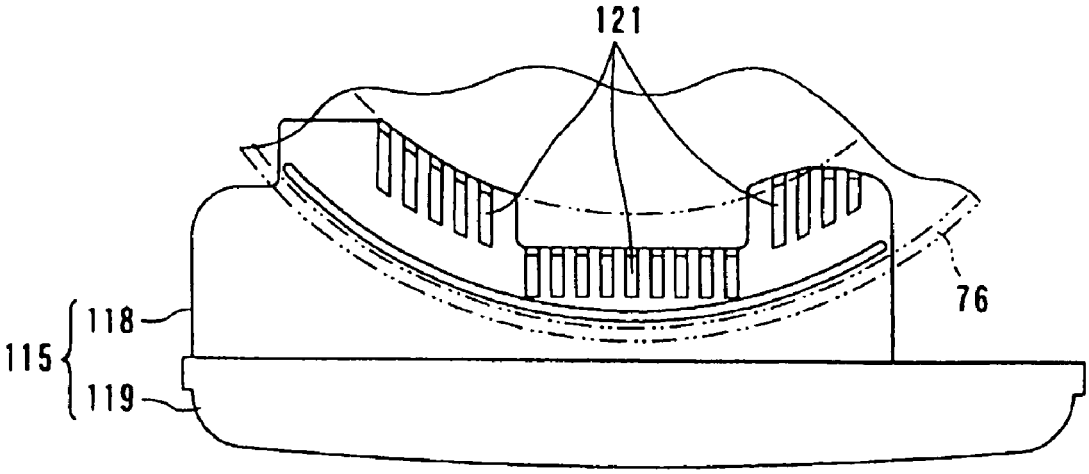
FIG. 12B is a plan view of the electrical part box shown in FIG. 12A.

As shown in FIG. 12B, the outlets 121 of the electrical part box 115 open at the suction side of the ventilation fan 101. More specifically, the outlets 121 open at portions of the lower surface of the fly-wheel 76 where the ventilation fan 101 is formed in the peripheral direction. By the rotation of the ventilation fan 101, outside air is forcibly blown into the electrical part box 115 as cooling air and ventilation air, and is sucked out by the ventilation fan 101 from the outlets 121 at the top portion of the electrical part box 115. Therefore, the inside of the electrical part box 115 is formed with forcibly cooling paths or ventilation paths 125 using outside air, so that electrical heat-generating parts in the electrical part box 115 are forcibly cooled.

By forming the inside of the electrical part box 115 with the forcibly cooling paths 125 and forcibly cooling the electrical heat-generating parts, such as coils and electrical current controllers, the parts operate stably, so that they are durable for a longer period of time and have a prolonged life. By forcibly cooling the electrical heat-generating parts, their sizes can be reduced, and the electrical heat-generating parts are disposed with greater freedom, so that the outboard motor 10 is made compact and light.

As shown in FIGS. 6, 12A, and 12B, the electrical part box 115 is internally divided into two by a vertical partition wall 127, with internally branched cooling paths being formed in the vertical direction. In the electrical part box 115, a box for accommodating each electrical part and a box for accommodating fuel parts are integrally formed. Since two cooling paths 125 are formed in the electrical part box 115, the inlets 120 and the ventilation separators 123 are formed in correspondence with the respective cooling paths 125. The electrical part box 115 has an electrical part accommodating section and a fuel part accommodating section, both of which have the respective box-shaped cooling paths 125 formed thereat.

The electrical parts, such as an engine control unit 130 (which incorporates a central processing unit (CPU)), a power trim and tilt (PTT) relay 131, a main relay or stator relay 132, and a fuse 133 are disposed in one of the cooling paths 125 of the electrical part box 115. The fuel parts, such as a fuel pump 135 (which is a low-pressure electromagnetic pump), are disposed in the other cooling path 125. The electrical heat-generating parts are mounted to the body 118 of the electrical part box 115. By forcibly circulating outside air in the electrical part box 115, each electrical part is vigorously and forcibly cooled.

Ventilation fresh air inlets 138 are also formed, one on the left and one on the right of the back portion of the lower engine cover portion 31 of the outboard motor 10. Ventilation separators 139 are also disposed at the respective fresh air inlets 138, and are mounted to the left and right inner portions of the lower engine cover portion 31. The fresh air inlets 138 open into the engine compartment 38 through the respective ventilation separators 139. Since outside air cools the inside of the engine compartment 38, the outside air is introduced as cooling air through the ventilation separators 139.

The vertical V-type multi-cylinder 4-cycle engine 15 is disposed in the engine compartment 38 of the outboard motor 10. Due to the demand for making the outboard motor 10 compact, the V-type multi-cylinder engine 15 is efficiently accommodated in the engine cover 27, so that the size of the engine compartment 38 tends to be small. As a result, heat that is generated by, for example, the engine tends to be confined within the upper portion of the engine compartment 38.

Figure 13:
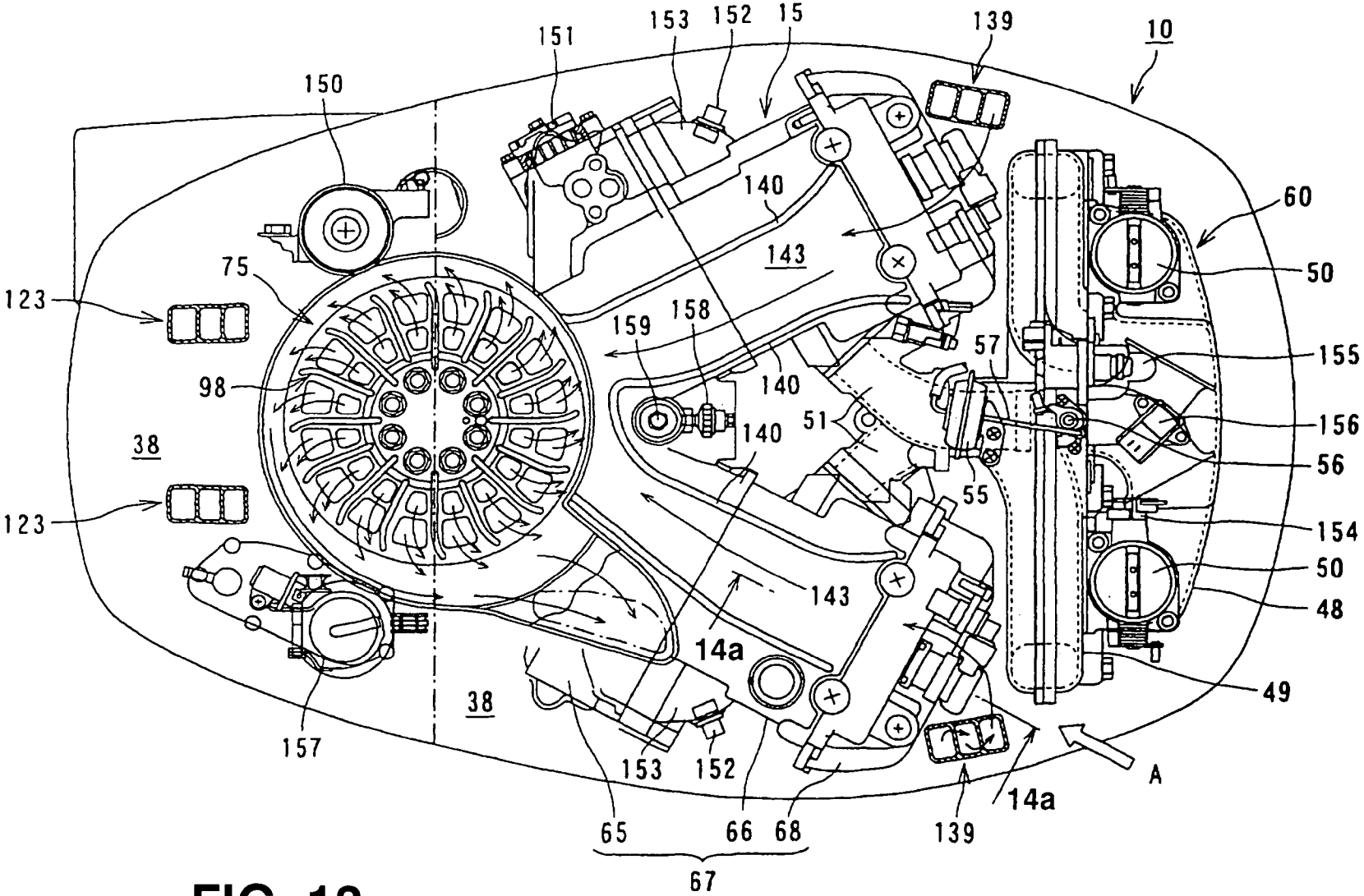
FIG. 13 is a top plan view of the V-type multi-cylinder engine disposed in the engine cover of the outboard motor of the present invention.

As shown in FIG. 13, in the outboard motor 10, a guide rib 140, serving as a ventilation inducing wall, is disposed in a standing manner at the top portion of the engine block 67 of the V-type multi-cylinder engine 15 from, for example, the cylinder heads 66 to the cylinder block 65 (crank case 64). The guide rib 140 is brought to a guide rib 141, which is disposed in a standing manner at the lower surface of the partition plate 40, so that a ventilation path 143 that communicates with an inlet of the ventilation fan 101 is formed, thereby allowing ventilation of the top portion of the engine compartment 38 where heat accumulates and discharge of the heated air. The ventilation path 143 is disposed at the upper portion of the engine compartment 38. It may be disposed with a tubular path structure by disposing a guide rib at either the engine block 67 or the partition plate 40. By disposing the ventilation path 143, the inside of the engine compartment 38 becomes a path extending from the ventilation fresh air inlets 138 to the ventilation path 143, thereby making it possible to vigorously and forcibly ventilate the inside of the engine compartment 38. The ventilation path 143, can have any cross-sectional shape including, for example, rectangular.

Figure 14A:
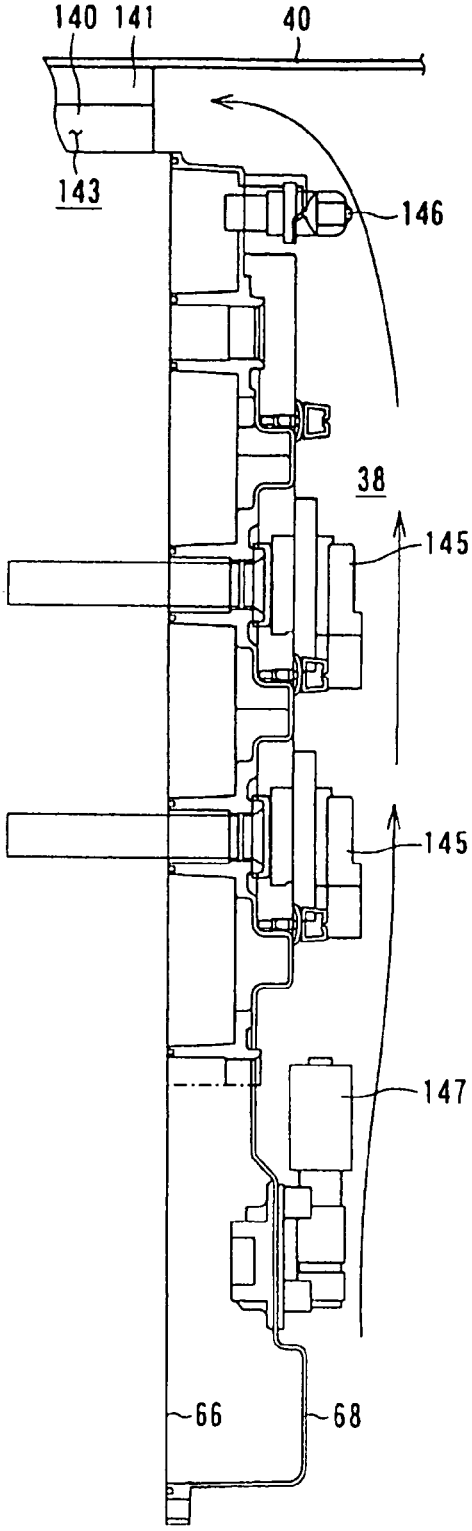
FIG. 14A is a schematic sectional view taken along line 14A—14A of FIG. 13.
Figure 14B:
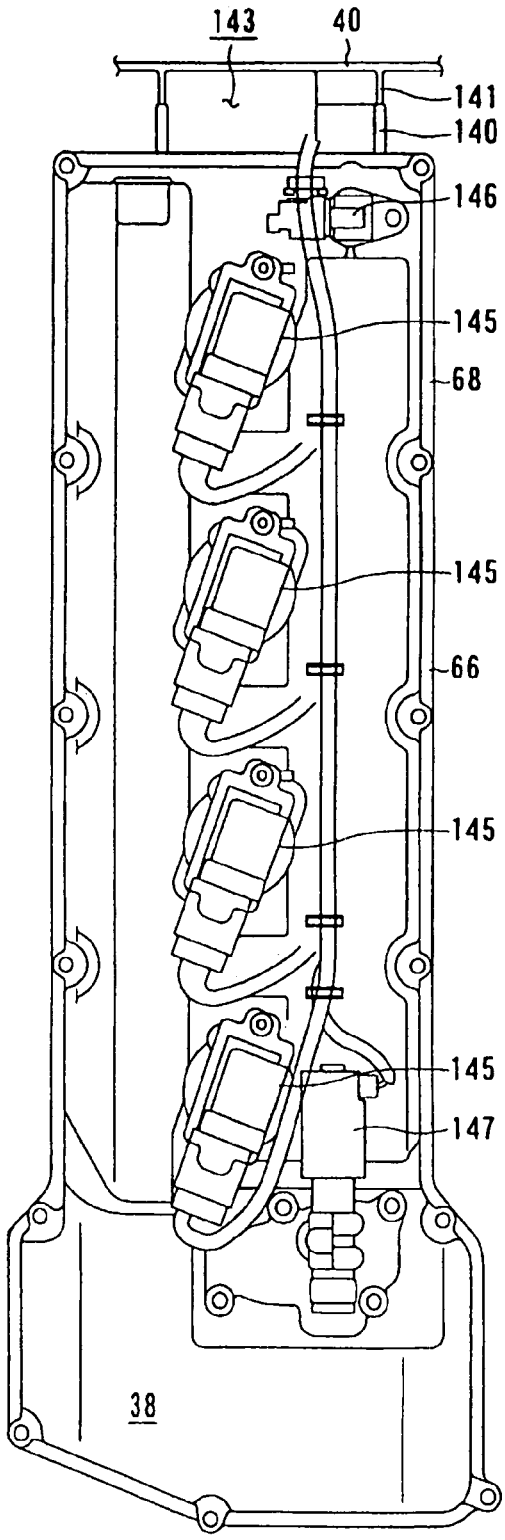
FIG. 14B is a sectional view of the V-type multi-cylinder engine as viewed in the direction of arrow A of FIG. 13.

As shown in FIGS. 14A and 14B, the electrical heat-generating parts, such as ignition coils 145, a cam angle sensor 146, and a variable valve timing drive actuator 147, are disposed at the cylinder head cover 68 as parts in the engine compartment. In order to efficiently cool each engine part, the ventilation fresh air inlets 138 are disposed at the lower portion of the engine compartment 38.

As shown in FIGS. 13, 14A, and 14B, outside air is introduced into the lower portion of the engine compartment 38 from the fresh air inlets 138 through the ventilation separators 139. Moisture which enters the fresh air inlets 138 along with the outside air is separated and removed by the ventilation separators 139, and is discharged to the outside from the lower portions of the ventilation separators 139.

The outside air that is guided to the lower portion of the engine compartment 38 flows upward in the engine compartment 38, during which time the outside air cools the parts in the engine compartment 38, and is guided to the ventilation path 143. The heat that is dissipated in the engine compartment 38 from the V-type multi-cylinder engine 15 and the heat-generating parts flows upward in the engine compartment 38 and accumulates at the upper portion of the engine compartment 38. The heat that accumulates at the upper portion of the engine compartment 38 is guided to the ventilation path 143 and the suction side of the ventilation fan 101 by suction of the air by the operation of the ventilation fan 101. The cooling air that is guided to the ventilation path 143 is forcibly sucked into the ventilation fan 101, and is emitted to the outside from the exhaust opening 107 of the top engine cover portion 33.

In FIG. 13, reference numeral 150 denotes a starter motor, reference numeral 151 denotes a rectifier and a regulator, reference numeral 152 denotes a temperature sensor disposed at an engine exhaust system 153, reference numeral 154 denotes a throttle opening sensor, reference numeral 155 denotes an air adjusting electromagnetic valve (idle speed control valve, ISC valve), reference numeral 156 denotes an negative intake pressure sensor, reference numeral 157 denotes a vapor separator, reference number 158 denotes an oil pressure sensor, and reference numeral 159 denotes a main gallery. The ignition coils, the electrical current controllers including current controlling parts, the starter motor, the regulator, various relays, and other such parts are disposed in the engine compartment 38.

Of the parts that are disposed in the engine compartment 38, the throttle opening sensor 154, the negative intake pressure sensor 156, and the air adjusting electromagnetic valve 155, which are disposed at the back side of the engine air-inlet system 60, are exposed at a cooling air path into which air flows from the ventilation fresh-air inlets 138, so that these parts are efficiently cooled. In addition, these parts are disposed at the air intake manifold 49 passing through the engine air-inlet system 60. Since the parts are cooled even by heat exchange resulting from engine intake, the parts are disposed at locations where overheating does not often occur, so that the throttle opening sensor 154, the negative intake pressure sensor 156, and the air adjusting electromagnetic valve 155 in the engine compartment 38 are vigorously cooled, as a result of which overheating can be reliably prevented.

In the outboard motor 10, the fly-wheel magneto device 75 is disposed at the top portion of the vertical crank shaft 20 of the V-type multi-cylinder engine 15, and the ventilation fan 101 is disposed in the magneto device 75. By the operation of the ventilation fan 101, the inside of the engine compartment 38 is vigorously and forcibly ventilated by cooling outside air and cooled.

In particular, the electrical part box 115, formed of resin, is resiliently held by a vibration-proof structure, and the cooling paths 125 are formed in the electrical part box 115. Accordingly, the electrical heat-generating parts, which include coils and current controllers, and which are accommodated in the electrical part box 115, that is, the engine controlling unit 130, the PTT relay 131, the main relay 132, and the fuse 133, and the fuel parts including the low-pressure electromagnetic fuel pump 135 are vigorously cooled, so that stable operation of each electrical part and each fuel part can be guaranteed. As a result, these parts are made durable for a longer period of time, thereby making it possible to maintain their performance and prolong their lives. In addition, since the electrical parts and fuel parts are completely separated from each other in the electrical part box 115 by the partition wall 127, the problem of fuel leaking from, for example, the fuel pump 135 is satisfactorily overcome.

The electrical part box 115 is resiliently supported by being mounted to the crank case 64 of the V-type multi-cylinder engine 15 by the resilient mount 116, so that its mounting structure is a vibration-proof mounting structure, thereby protecting the electrical parts and fuel parts that are easily adversely affected by vibration.

Even in a large outboard motor 10 comprising a V-type multi-cylinder engine having an engine displacement greater than 3000 cc, the body of the outboard motor 10 can be reduced in size and weight and made compact by reducing the overall height. Therefore, the space occupied by the engine compartment 38 in the engine cover 27 is saved. In general, in order to reduce the size of each electrical part for making the outboard motor compact and light, cooling of the electrical parts is indispensable.

In the outboard motor 10, since the cooling paths 125 are formed in the electrical part box 115 in order to vigorously and forcibly cool the electrical parts and the fuel parts with the ventilation fan 101, each electrical part is reduced in size, so that the outboard motor 10 is compact and light.

When the outboard motor 10 is driven or maintained, it is necessary to prevent water from getting onto the electrical parts that are easily adversely affected by water. In the outboard motor 10, the ventilation fresh air inlet 124 is disposed in the lower portion of the electrical part box 115, with outside air from the ventilation fresh air inlet 124 being guided to the electrical part box 115 through the ventilation separators 123. Each ventilation separator 123 has a labyrinth structure, and separates and removes water that enters along with outside air. The water is discharged outside the outboard motor 10 by being dropped out from holes and slits in the lower portion of each ventilation separator 123.

Therefore, when the outboard motor 10 is driven or maintained, it is possible to prevent water from getting onto the electrical parts in the electrical part box 115. In addition, since the electrical parts and fuel parts are separated from each other in the electrical part box 115 by the partition wall 127, a soundproof heat-insulating structure is formed, so that it is possible to restrict the amount of noise that leaks out of the fuel pump 135, thereby reducing noise.

As shown in FIG. 7, the fly-wheel 76 of the fly-wheel magneto device 75 has, as a whole, the shape of a hat that is close to the shape of a flat disk, and is stably mounted to the outer peripheral flange 79 at the top portion of the vertical crank shaft 20. By forming the fly-wheel 76 into a shape that is close to the shape of a flat disk and securing the recessed mounting portion at the central portion of the fly-wheel 76 to the outer peripheral flange 79, it is possible to lower the position of the center of gravity of the fly-wheel 76, so that the fly-wheel 76 can be stably rotated.

In order to vigorously and forcibly cool the engine compartment 38 and the electrical part box 115 with the ventilation fan 101, disposed at the fly-wheel 76, the vent holes 97 are formed in the curved plate 85 at the intermediate area of the fly-wheel 76. The fly-wheel 76 is lightened by the formation of the vent holes 97. It is possible to lighten the fly-wheel 76 by a few percent to 40% or more of the weight of a related fly-wheel of the same type.

Since, even if the fly-wheel 76 is lightened, it is reinforced by forming the ventilation fins 98 in the form of ribs and radially on the curved plate 85, the fly-wheel 76 is strengthened. Since the ventilation fins 98, which are reinforcing members, are formed over the entire curved plate 85 from the disk-shaped mounting portion to the sleeve 86, even if a large inertia (moment of inertia) acts upon the curved plate 85 when the fly-wheel 76 rotates, the curved plate 85, which has a low strength, is reinforced by the reinforcing ribs 99.

In the outboard motor 10, the engine compartment 38 is formed below the partition plate 40 by the upper and lower engine cover portions 31 and 32 of the engine cover 27, and the engine inlet space is formed above the partition plate 40 so as to be separated from the engine compartment 38. By the upper engine cover portion 32 and the top engine cover portion 33, a path of the engine air-inlet system 60 is completely independently formed. By the top portion 32*a* of the upper engine cover portion 32 and the partition plate 40 below the top portion 32*a*, the exhaust path 104 is independently formed of the engine inlet space.

The partition plate 40 is a partition cover integrally formed with the fly-wheel magneto cover 100, and the upper and lower spaces divided by the partition plate 40 are divided into the suction side and the discharge side of the ventilation fan 101 disposed in the fly-wheel magneto device 75. The partition plate 40 extends towards the left and right and towards the back with the shape of the fly-wheel magneto cover 100 being in correspondence with the shape of the engine cover 27, and is hermetically mounted to the top portion 32*a* of the upper engine cover portion 32 from below. The partition plate 40 is formed so that, in general, the engine inlet space (path) is disposed above the partition plate 40, and the engine compartment 38 including the heat-generating sources is disposed below the partition plate 40.

Forcibly cooling paths or ventilation paths using the ventilation fan 101 are formed in the electrical part box 115 and the engine compartment 38, which are disposed below the partition plate 40. These cooling paths are separated from an intake path of the engine air-inlet system 60.

When the temperature of combustion air that is guided to the engine air-inlet system 60 is increased by heat dissipation from the V-type multi-cylinder engine 15 and hot lubricating oil circulating in the engine 15, the air density is reduced, so that engine output is reduced. However, the outboard motor 10 has a structure in which the combustion air that is sucked through the engine air-inlet system 60 is separated from the heat-generating sources, so that it is not affected by the heat dissipation and the hot lubricating oil.

When the fuel temperature in the outboard motor 10 becomes high, fuel evaporation occurs, so that it is desirable for the fuel parts, such as the fuel pump 135, to be formed so that they are not affected by heat dissipation resulting from combustion in the engine and hot lubricating oil circulating in the engine. In the outboard motor 10, the cooling paths 125 and air paths of the engine compartment 38 are formed between the ventilation fresh air inlet 124 and the ventilation fan 101, and the vapor separator 157 and the fuel parts, such as the fuel pump 135, are disposed upstream from the cooling paths 125 and the air paths. By disposing the cover 117 between the fuel parts and the engine block 67, the fuel parts are shielded from heat that is dissipated from the engine block 67.

In order for the magneto device 77 of the fly-wheel magneto device 75 to be a large heat-generating source, and, at the same time, to have enhanced electrical power generation performance and to be durable for a long period of time, it is necessary to cool (ventilate) the magneto device 77 to the extent that it is not overheated. In the fly-wheel magneto device 75, the ventilation fan 101 at the fly-wheel 76 vigorously cools the coil of the magneto device 77. By cooling the magneto device 77, overheating of the coil of the magneto device 77 can be prevented, thereby making it possible to increase the durability of the electrical-power generating coil, to prevent an increase in the resistance of the electrical-power generating coil, and to prevent a reduction in its electrical power generation performance.

The outboard motor 10 of the aforementioned type is demanded to have high electrical-power generation performance due to electronic control of the V-type multi-cylinder engine 15 and the widespread use of various marine electrical products, such as a fish finder, a GPS device, a radio communication apparatus, an audio/video product, an electric winch, a bilge pump, and a lighting system.

Of the various marine electrical products, many of them, such as a fish finder, are used when the ship is sailing at a low speed. Therefore, they are required to generate electrical power with high efficiency at low-speed rotation. After the outboard motor 10 has moved to its destination at intermediate/high speed rotation, a person may, for example, do some fishing (trolling) using a fish finder when the ship is sailing at a low speed for a long time, or do work for a long time at low-speed sailing (little noise and vibration) that may oppose the flow of the wind and tides, or use a marine electrical product for leisure purposes. Therefore, marine electrical products are very frequently used at low-speed rotation, and, thus, are required to provide enhanced electrical power generation performance at low-speed rotation.

In the outboard motor 10, the diameter of the fly-wheel 76 of the fly-wheel magneto device 75 can be large, and the magneto device 77 at the fly-wheel 76 can be efficiently cooled. Since the fly-wheel 76, whose overall weight is considerably reduced, has large inertia, the magneto device 77 can efficiently and effectively generate electrical power. In particular, by increasing the diameter of the fly-wheel 76, the diameters of the outer peripheral portion of the magneto stator 91 and the magneto rotor 90 can be increased, so that it is possible to provide enhanced electrical-power generation performance in a low-speed engine rotation area.

The fly-wheel 76 of the outboard motor 10 has the function of smoothing out variations in torque at each time interval between combustion in the V-type multi-cylinder engine 15. A very large inertial force acts upon the portion where the crank shaft 20 and the fly-wheel 76 are joined and each portion of the fly-wheel 76. Considering the load resulting from ship traversing resistance depending on, for example, the draft line position or buoyancy of the ship incorporating the outboard motor 10, the outboard motor 10 is required to be light and achieve high output. Portions of the fly-wheel 76 that do not contribute to inertial force, and portions of the fly-wheel 76 that contribute slightly to inertial force can be considerably lightened. Even if the fly-wheel 76 is lightened, it can have large inertial force, so that a large output is achieved.

In the V-type multi-cylinder engine 15, deformation and/or vibration of the crank shaft 20 (crank bending and twisting) caused by the inertial force and combustion force of a reciprocating section of the piston 70 causes a very large force to be exerted upon the flange where the crank shaft 20 and the fly-wheel 76 are joined and each part of the fly-wheel 76.

In the outboard motor 10, the amount of protrusion of the crank shaft 20 from the crank case 64 is small, so that the flat fly-wheel 76 whose center of gravity is lowered in position is stably mounted and fastened to the outer peripheral flange 79 at the top portion of the crank shaft 20 with high mounting precision.

In the outboard motor 10, it is possible for the crank shaft 20 and the fly-wheel 76 to be strongly joined together. By considerably lightening the central portion and intermediate area of the fly-wheel 76, it is possible to lighten the fly-wheel 76. Even if the fly-wheel 76 is lightened, the ventilation fins 98 are radially disposed in a standing manner in the form of ribs on at least the intermediate area of the fly-wheel 76, so that the fly-wheel 76 is strengthened. Therefore, even if the fly-wheel 76 is lightened, it can have a large diameter with high mechanical and physical strength. Consequently, the fly-wheel 76 has a strength in correspondence with a large inertial force.

In the outboard motor 10, the fly-wheel 76 having a large moment of inertia and weight is disposed at an offset position that is situated upward from a portion that supports the vertical crank shaft 20 (bearing at the upper end of the multi-cylinder engine 15). In the outboard motor 10, however, the lower portion of the fly-wheel 76 is mounted to the outer peripheral flange 79 of the vertical crank shaft 20, so that the position of the center of gravity of the fly-wheel 76 can be lowered.

The larger the distance (offset amount) between the portion that supports the crank shaft 20 and the center of gravity of the fly-wheel 76, the more does slight variations in rotational balance of the fly-wheel 76 increase vibration, so that a large load is generated at the crank shaft 20 and the portion that supports the crank shaft 20. In the outboard motor 10, however, since the position of the center of gravity can be lowered by reducing the overall height of the fly-wheel 76, it is possible to prevent vibration and increase durability of the fly-wheel 76. Therefore, it is possible to effectively prevent vibration of the outboard motor 10 and lighten it, so that it can be compact and more durable.

In the outboard motor 10, by lowering the position of the center of gravity by reducing the overall height of the fly-wheel 76, the vertical size of the fly-wheel 76 can be reduced, so that it is vertically compact. Therefore, it is possible to reduce the size of the engine cover 27, and to reduce the overall height of the outboard motor 10 and make it compact, so that it can be designed with greater freedom.

The outboard motor 10 has many uses in the low-speed rotation region. In order to accommodate variations in rotation of the engine caused by variations in torque occurring each time combustion in the engine occurs and to prevent sudden load variations (reduction in rotation due to, for example, shifting) in the low-speed rotation area, the fly-wheel 76 is required to have a large moment of inertia. Even if the fly-wheel 76 is lightened, it is formed with a large diameter, so that, by increasing the weight of the outer peripheral portion of the fly-wheel 76, it is possible for the inertia of the fly-wheel 76 to be equal to or greater than the inertia of a related fly-wheel, as a result of which the fly-wheel 76 can have a sufficient moment of inertia in terms of the required moment of inertia.

Considering the load (ship traversing resistance) depending on, for example, the draft line position of the hull 11 or buoyancy of the ship incorporating the outboard motor 10, the outboard motor 10 is required to be light and achieve high engine output. In the outboard motor 10, the fly-wheel 76 is lightened, but provides a large inertial force (moment of inertia). Since the fly-wheel 76 and the crank shaft 20 are required to have physical/mechanical strength and a large moment of inertia, they are formed of iron materials, which have high specific gravity. Therefore, removing only a small portion of the fly-wheel 76 and crank shaft 20 considerably reduces their weight. Even if the fly-wheel 76 is lightened, the weight of the outer peripheral portion of the fly-wheel 76 that greatly contributes to providing inertial force is unchanged, so that the fly-wheel can provide a large inertial force.

Modifications of the Fly-Wheel Magneto Device

Figure 15:
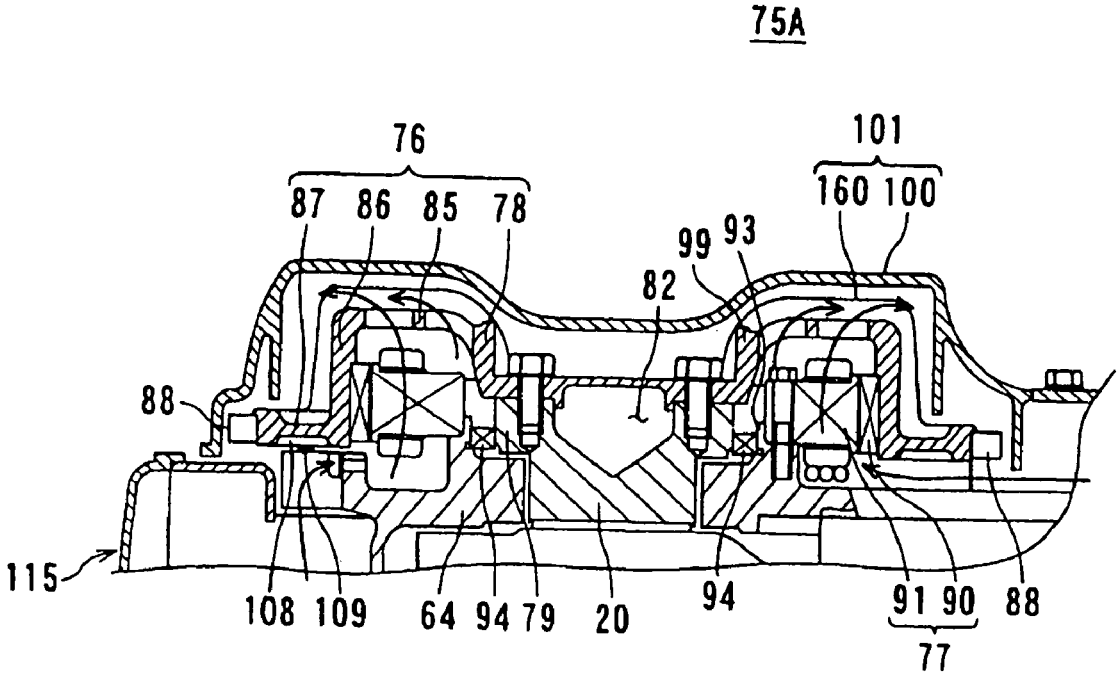
FIG. 15 is a sectional side view of another embodiment of the fly-wheel magneto device of the outboard motor of the present invention.

In the embodiment of the outboard motor, as shown in FIG. 7, the ventilation fan 101, which is disposed in the fly-wheel magneto device 75, has ventilation fins 98 radially disposed on the curved plate 85 of the fly-wheel 76. However, as shown in FIG. 15, a fly-wheel magneto device 75A may have an even number of ventilation fins 160 integrally disposed in the form of ribs and radially from the outer periphery of a center disk-shaped mounting portion 78 to an outer peripheral flange 87 via a curved plate 85 and a sleeve 86. As shown in FIG. 15, by forming the ventilation fins 160 as reinforcing ribs, the fly-wheel 76 is further strengthened, so that the mechanical/physical strength of the fly-wheel 76 having a large inertia can be increased.

Figure 16:
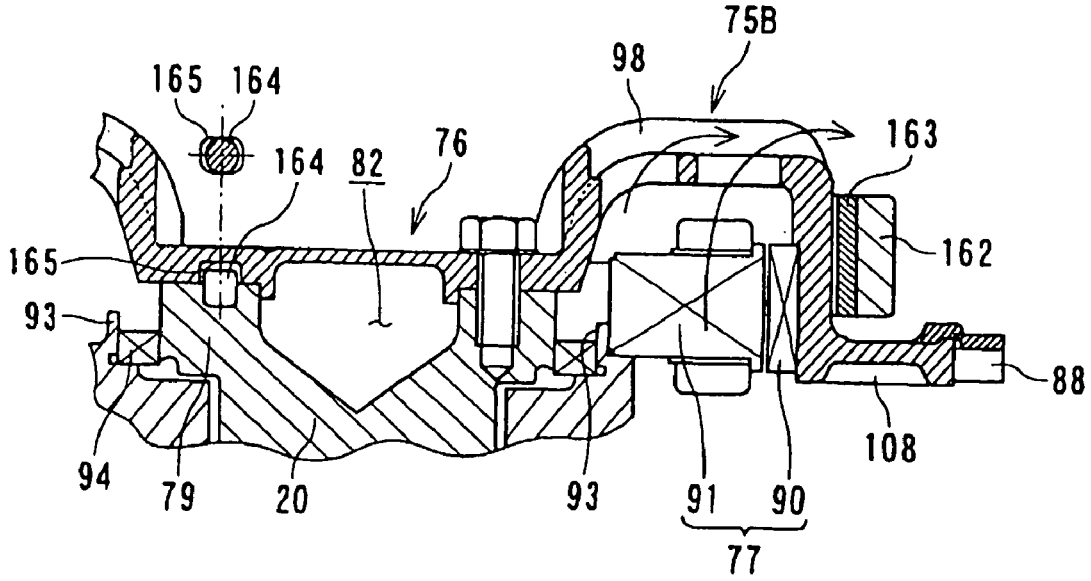
FIG. 16 is a sectional side view of another embodiment of the fly-wheel magneto device.

The fly-wheel magneto device may have the structure shown in FIG. 16. In a fly-wheel magneto device 75B, a torsion prevention ring 162 and a torsion damper 163 are disposed at a sleeve of a fly-wheel 76. By disposing the torsion damper 163 at the torsion prevention ring 162, the inertial force of the fly-wheel 76 is increased, and the torsion of the fly-wheel 76 is prevented from occurring, so that the fly-wheel 76 rotates stably. Positioning pins 164 with portions 165 of larger outer dimension aid in positioning the fly-wheel magneto device 75B.

Figure 17:
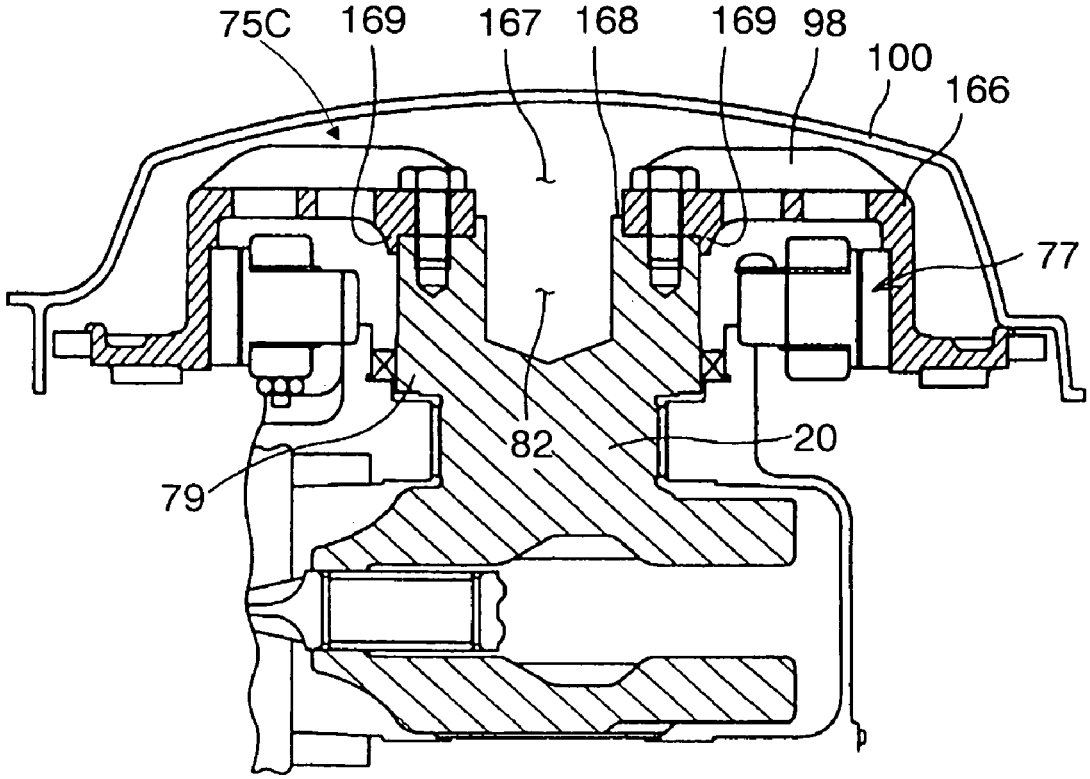
FIG. 17 is a sectional view of another embodiment of the fly-wheel magneto device.

The fly-wheel magneto device may have the structure shown in FIG. 17. In a fly-wheel magneto device 75C, a hole 167 is formed through the central portion of a fly-wheel 166, and the fly-wheel 166 is secured to an outer peripheral flange 79 of a vertical crank shaft 20 by, for example, tightening bolts. In order to stably mount the fly-wheel 166 to the outer peripheral flange 79 of the crank shaft 20, an upwardly protruding annular protrusion 168 is disposed as a centering location around a hole 82 in the outer peripheral flange 79, and a downwardly protruding annular protrusion 169, which is fitted to the outer peripheral flange 79, is disposed as a centering location at the lower surface of the central portion of the fly-wheel 166.

In the fly-wheel magneto device 75C, the upwardly protruding annular protrusion 168, which is formed at the outer peripheral flange 79 of the crank shaft 20, is fitted to the hole 167 of the fly-wheel 166, and the downwardly protruding annular protrusion 169 of the fly-wheel 166 is externally fitted to the outer peripheral flange 79 of the crank shaft 20. In this way, the annular protrusions 168 and 169 are disposed at the outer peripheral flange 79 of the crank shaft 20 and at the central portion of the fly-wheel 166, respectively. By centering and joining the annular protrusions 168 and 169, the fly-wheel 166 is stably secured to the outer peripheral flange 79 of the crank shaft 20 with high mounting precision.

Figure 18:
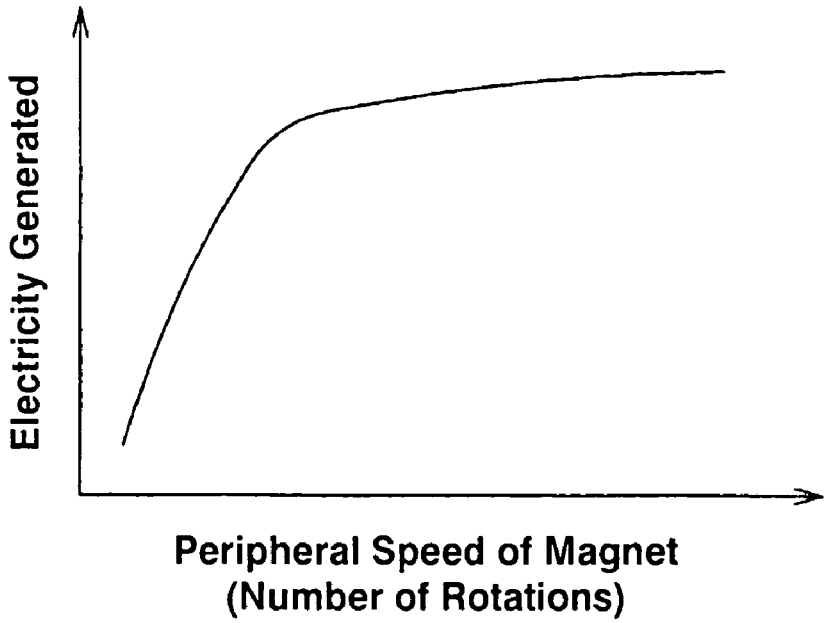
FIG. 18 is a characteristic diagram of electrical power generation, showing the relationship between the number of engine rotations and amount of electrical power generation in the fly-wheel magneto device of the outboard motor of the present invention.

FIG. 18 is a characteristic diagram of electrical power generation of the magneto device 77, attaching importance to the electrical power generation performance in a low-speed engine rotation region of the outboard motor 10.

In the outboard motor 10, in the low-speed engine rotation region, an increase in the number of rotations of the engine considerably increases engine output. In a medium-/high-speed engine rotation region, an increase in the number of rotations of the engine results in the engine output being substantially constant. In the outboard motor 10, since the outside diameter of the coil of the magneto device 77 is increased, when the number of rotations is the same, the peripheral speed of the magnet opposing the coil is increased, so that the electrical generation power in the low-speed rotation region is increased, and the stator coil can be thin due to an increase in the coil area. Since the outboard motor is constructed so that the outer peripheral wall (heavy load) of the sleeve of the fly-wheel 76 holding the magnet moves away from the center of rotation when the outside diameter of the coil of the magneto device 77 is increased, the fly-wheel 76 is reinforced by ventilation fins disposed in the form of ribs. Therefore, it has sufficient mechanical/physical strength.

Alternate embodiments of the electrical part box are described below.

As shown in FIG. 2, the electrical part box 115 disposed in the engine compartment 38 of the outboard motor 10 is described as communicating with the fresh air inlet 124 through the ventilation separators 123. Another structure may be used as shown in FIG. 19A, in which ventilation separators 170 are incorporated in the electrical part box 115, and communicate with ventilation fresh air inlets 124 of the lower engine cover portion 31 through respective communicating tubes 171.

Figure 19B:
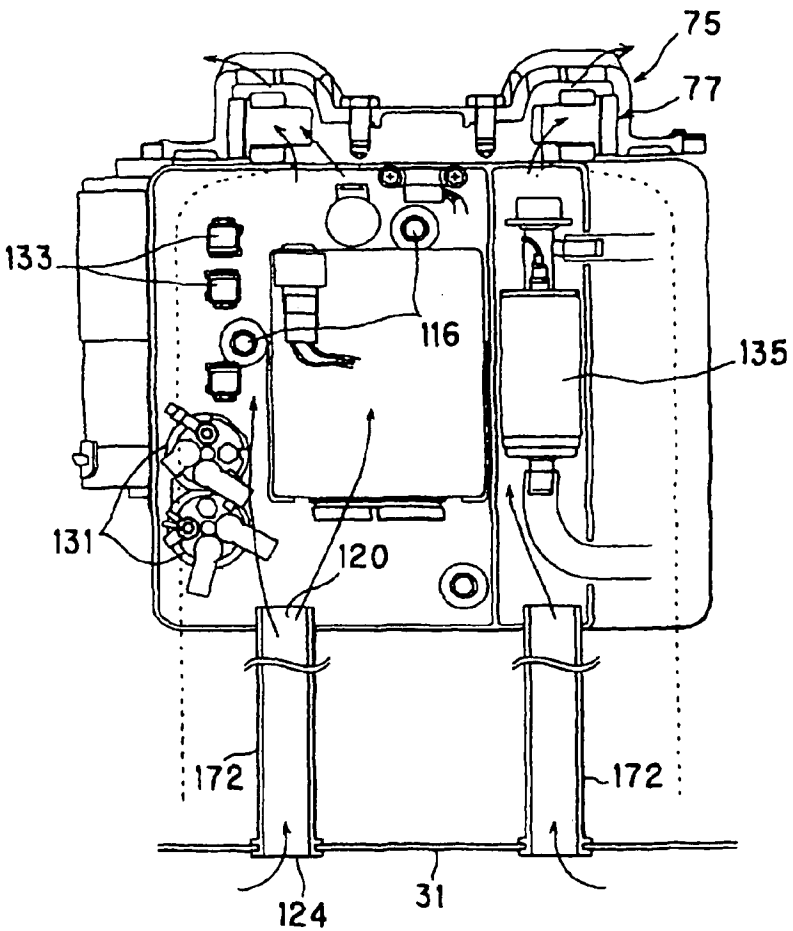
FIG. 19B is a side view showing a mounted electrical part box, according to another embodiment of the present invention.

Another structure, as shown in FIG. 19B, includes ventilation separators that are not disposed in the electrical part box 115, and inlets 120 of the electrical part box 115 communicate with ventilation fresh air inlets 124 through communicating tubes 172.

Figure 19A:
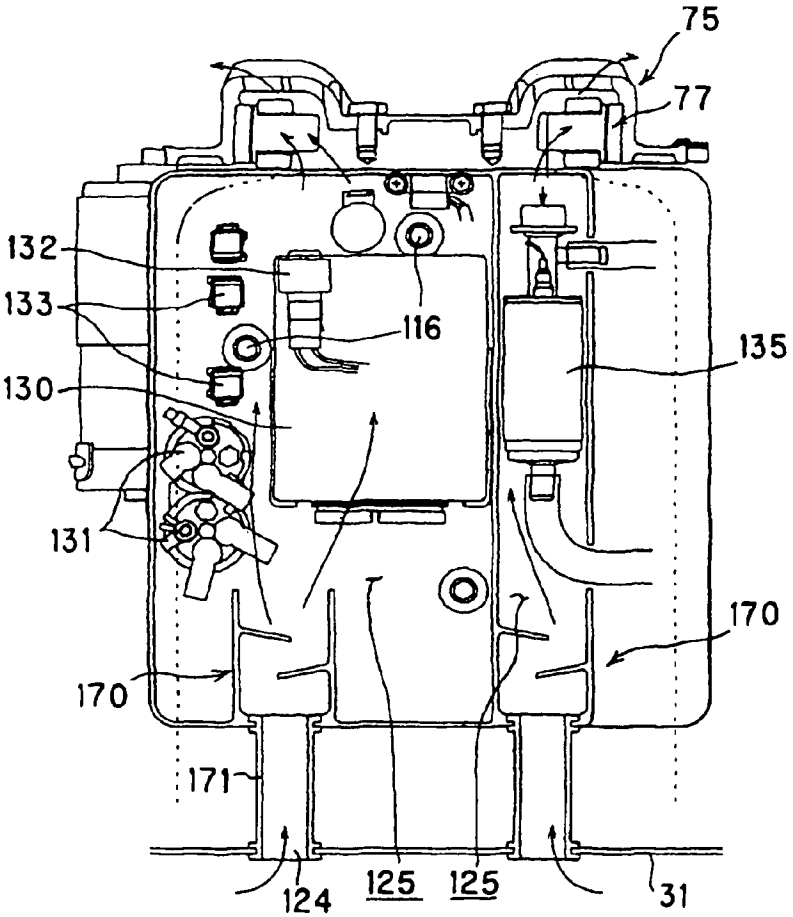
FIG. 19A is a side view showing a mounted electrical part box, according to an embodiment of the present invention.
Figure 20:
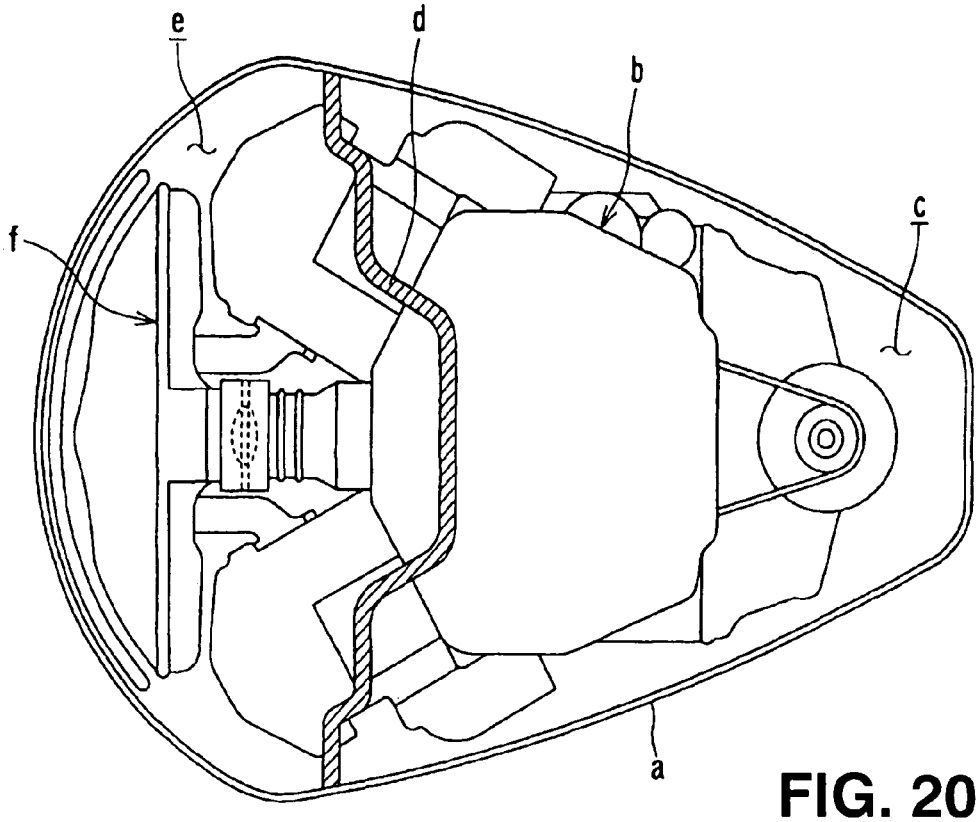
FIG. 20 (Prior Art)
FIG. 20 illustrates a prior-art outboard motor showing the relationship between an engine inlet space and an engine compartment.
Figure 21:
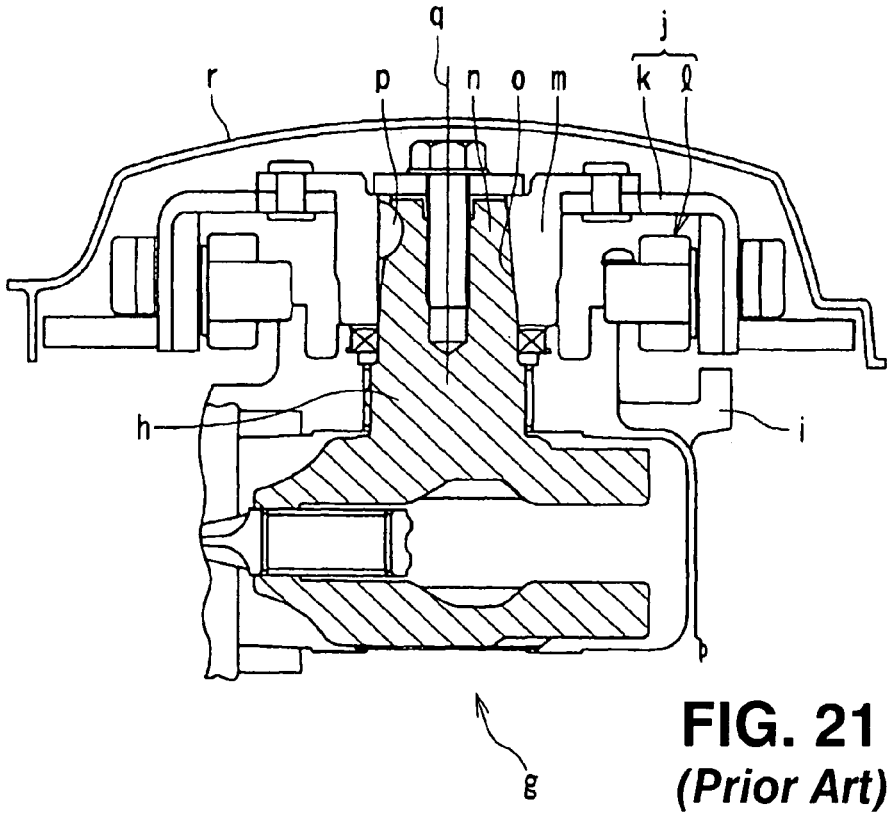
FIG. 21 (Prior Art)
FIG. 21 illustrates a prior-art outboard motor showing a mounted state of a fly-wheel magneto device.

Each of the electrical part boxes 115 shown in FIGS. 19A and 19B communicates with the suction side of the ventilation fan 101 and the inside thereof is formed into forcibly cooling paths 125. By forming the inside of the electrical part box 115 into forcibly cooling paths 125, each electrical part and each fuel part can be vigorously and forcibly cooled, so that cooling efficiency can be increased.

Although the outboard motor of the embodiment of the present invention is described as incorporating a V-type vertical 8-cylinder 4-cycle engine, the outboard motor may incorporate other types of V-type multi-cylinder engines, such as a V-type 6-cylinder engine, instead of the V-type 8-cylinder engine.

The outboard motor of the present invention comprises an engine air inlet space and an engine compartment that are independently formed to effectively and forcibly ventilate the engine compartment and effectively exhaust heat, so that overheating of the parts in the engine compartment is prevented. As a result, the density of combustion air is maintained at a suitable density, thereby increasing engine output.

In the outboard motor of the present invention, overheating of the parts in the engine compartment is effectively prevented, thereby stably and properly maintaining the operational functions of the parts in the engine compartment, so that the parts are durable for a longer time and have increased life. In addition, the overall height of the fly-wheel is reduced, the position of its center of gravity is lowered, and the fly-wheel is lightened. Even if the fly-wheel is lightened, the fly-wheel is stably joined and mounted to the flange of the crank shaft, and the amount of inertia can be increased by increased strength of the joining portion (flange), so that it is possible to accommodate variations in rotation caused by variations in torque of the engine, and to effectively accommodate changes in load in a low-speed rotation region.

In the present invention, the outboard motor comprises a fly-wheel magneto device that is lightened, has its center of gravity lowered in position, and has its overall height reduced. The outboard motor can maintain a high electrical power performance while restricting the overall height, is compact, light, and designed with greater freedom. In addition, by forcibly ventilating the engine compartment, the outboard motor can efficiently and effectively prevent overheating of the parts in the engine compartment, so that the parts, such as the electrical parts, in the engine compartment, operate stably and are durable for a long time.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An outboard motor comprising:

a vertical multi-cylinder engine, disposed in an engine cover, comprising a crank case and a crank shaft, the crank shaft being rotatably disposed and comprising a protruding portion protruding upward from the crank case;

a fly-wheel magneto device disposed on the protruding portion of the crank shaft;

a partition plate, disposed in the engine cover, for partitioning the inside of the engine cover into an engine air-inlet space and a space including a heat-generating source, the engine air-inlet space being disposed at an upper portion of the engine cover, and the space including a heat-generating source being disposed at a lower portion of the engine cover; and a ventilation fan disposed in the lower space below the partition plate.

2. An outboard motor according to claim 1, wherein the lower engine cover portion and the upper engine cover portion are separable from each other, and wherein the engine cover has a suction fresh air inlet and a ventilation fresh air inlet, with the suction fresh air inlet opening into the engine air-inlet space of the engine cover and the ventilation fresh air inlet opening into the lower space of the engine cover.

3. An outboard motor according to claim 1, wherein the engine cover further comprises a top engine, cover portion, wherein the lower engine cover portion, the upper engine cover portion, and the top engine cover portion are vertically separable from each other, wherein the partition plate is disposed in an air-tight manner below the top portion of the upper engine cover portion, and wherein the engine cover comprises an engine compartment which is disposed below the partition plate and which is defined by the lower engine cover portion and the upper engine cover portion.

4. An outboard motor according to claim 3, further comprising an intake silencer, disposed at an upper surface of the partition plate, comprising a box-shaped casing and having a water-entry prevention structure.

5. An outboard motor comprising:

a vertical multi-cylinder engine, disposed in an engine cover, comprising a crank case and a crank shaft, the crank shaft being rotatably disposed and comprising a protruding portion protruding upward from the crank case; and a fly-wheel magneto device, disposed on the protruding portion of the crank shaft, comprising a ventilation fan having a centrifugal fan structure, wherein the ventilation fan has an inlet side that communicates with a ventilation path that opens into an engine compartment, and an exhaust side that communicates with an exhaust opening of the engine cover;

the ventilation path is formed above an engine block of the vertical multi-cylinder engine: and the protruding portion of the crank shaft of the multi-cylinder engine has an outer peripheral flange, wherein the fly-wheel magneto device further comprises a fly-wheel whose central mounting portion is secured to the outer peripheral flange of the crank shaft, and wherein an upper portion of the fly-wheel is provided with a plurality of ventilation fins that are radially disposed in a standing manner.

6. An outboard motor according to claim 5, wherein the fly-wheel magneto device further comprises a fly-wheel whose upper portion is provided with a plurality of ventilation fins that are disposed in the form of ribs in a standing manner, and wherein adjacent ventilation fins are disposed at unequal intervals.

7. An outboard motor according to claim 5, wherein the fly-wheel magneto device further comprises a fly-wheel whose upper portion is provided with a plurality of ventilation fins disposed in a standing manner, wherein inner peripheral sides of the ventilation fins are joined together with a reinforcing annular rib, and wherein the fly-wheel has a plurality of vent holes penetrating through the fly-wheel and being disposed between adjacent ventilation fins.

8. An outboard motor according to claim 5, wherein the fly-wheel magneto device further comprises a fly-wheel including a recessed mounting portion disposed at a central portion of the fly-wheel is fastened to an outer peripheral flange of the crank shaft, which is a vertical type, and wherein an upper portion of the fly-wheel is provided with a plurality of ventilation fins that are radially disposed from the mounting portion to a sleeve disposed at an outer peripheral side of the fly-wheel.

9. An outboard motor according to claim 5, wherein the fly-wheel magneto device further comprises a fly-wheel having an upper portion including a plurality of ventilation fins disposed radially to an outer peripheral flange of the fly-wheel from an outer periphery of a mounting portion disposed at a central portion of the fly-wheel through a curved plate and a sleeve of the fly-wheel.

10. An outboard motor according to claim 5, further comprising a guide rib disposed in a standing manner between an engine block of the vertical multi-cylinder engine and a partition plate dividing an internal space of the engine cover, wherein a ventilation path which connects the engine compartment to a suction side of the ventilation fan is disposed by disposing the guide rib.

11. An outboard motor according to claim 10, further comprising a positioning pin, a slotted pin hole, and a marker, the positioning pin being implanted in one of two mounting surfaces where an outer peripheral flange of the crank shaft, which is vertically oriented, and a mounting portion of the fly-wheel are mounted, the slotted pin hole being disposed in the other mounting surface and fitted to the positioning pin, and the marker being disposed in a radial position on the fly-wheel in correspondence with the positioning pin for confirming a mounting angle of the fly-wheel.

12. An outboard motor according to claim 5, wherein the ventilation path is formed above at least one of a cylinder block and a cylinder head of the engine block of the vertical multi-cylinder engine.

13. An outboard motor comprising:

a vertical multi-cylinder engine, disposed in an engine cover, comprising a crank case and a crank shaft, the crank shaft being rotatably disposed and comprising a protruding portion protruding upward from the crank case; and a fly-wheel magneto device, disposed on the protruding portion of the crank shaft, comprising a ventilation fan having a centrifugal fan structure, wherein the inside of the engine cover is divided into an engine air-inlet space, disposed at an upper portion of the engine cover, and an engine compartment, disposed at a lower portion of the engine cover, with a partition plate being used to divide the inside of the engine cover, and wherein the ventilation fan includes an inlet side that opens into the engine compartment and an exhaust side that communicates with an exhaust opening of the engine cover;

the upper portion of the engine cover comprises fresh air inlets for receiving outside air:

part of the partition plate is a fly-wheel magneto cover, and the fly-wheel magneto cover includes an exhaust inducing path that communicates with the exhaust opening of the engine cover from a portion of the fly-wheel magneto cover in a peripheral direction.

14. An outboard motor according to claim 13, further comprising an electrical part box resiliently disposed in the engine compartment in the engine cover, and wherein one side of the electrical part box communicates with a ventilation fresh air inlet of the engine cover and another side of the electrical part box opens at a suction side of the ventilation fan, so that a ventilation path is disposed in the electrical part box.

15. An outboard motor according to claim 14, wherein the electrical part box further comprises a fuel part accommodating section, the fuel part accommodating section including a ventilation path.

16. An outboard motor comprising:

a vertical multi-cylinder engine, disposed in an engine cover, comprising a crank case and a vertical crank shaft, the crank shaft being rotatably disposed and comprising a protruding portion protruding upward at an upper end of the vertical crank shaft from the crank case; and a fly-wheel magneto device, disposed on the protruding portion of the crank shaft, comprising a fly-wheel and a magneto device having an electrical power generating function, wherein the fly-wheel is joined at a centering location to an outer peripheral flange of the protruding portion at the upper end of the vertical crank shaft.

17. An outboard motor according to claim 16, wherein the centering location for joining the fly-wheel to the outer peripheral flange of the vertical crank shaft comprises at least one of an axially extending hole and an annular protrusion, the hole being disposed in the outer peripheral flange of the crank shaft and the annular protrusion being disposed at the fly-wheel and being fitted to an outer peripheral surface of the outer peripheral flange of the crank shaft.

18. An outboard motor according to claim 16, wherein the centering location for joining the fly-wheel to the outer peripheral flange of the vertical crank shaft comprises annular protrusions, one of the annular protrusions being disposed at the fly-wheel and fitted to an outer peripheral surface of the outer peripheral flange of the vertical crank shaft and the other annular protrusion being disposed at the outer peripheral flange of the crank shaft and fitted to a central hole in the fly-wheel.

19. An outboard motor according to claim 16, wherein the fly-wheel comprises a recessed mounting portion at a central portion, wherein the mounting portion is fastened to the outer peripheral flange of the crank shaft, and wherein the outer peripheral flange of the crank shaft has a mounting surface that is positioned below an upper surface of a stator coil of the magneto device.

20. An outboard motor according to claim 16, wherein the magneto device comprises an annular stator disposed at the outer peripheral side of the crank shaft, wherein the stator is mounted to a mounting surface of an upper portion of the crank case of the vertical multi-cylinder engine, and wherein the outboard motor further comprises an oil seal that is disposed between the crank shaft and the crank case and near the stator.

21. An outboard motor according to claim 16, wherein the fly-wheel magneto device further comprises a trigger pole disposed at a lower surface of an outer peripheral flange of the fly-wheel, and wherein the crank case comprises a crank angle sensor opposing the trigger pole.

* * * * *